US010421468B2

(12) United States Patent
Golembiewski et al.

(10) Patent No.: US 10,421,468 B2
(45) Date of Patent: Sep. 24, 2019

(54) RAILROAD CAR ROLLER BEARING ADAPTER ASSEMBLY

(71) Applicant: Standard Car Truck Company, Rosemont, IL (US)

(72) Inventors: Ronald D. Golembiewski, Chicago, IL (US); David M. East, Libertyville, IL (US); Michael K. Burke, Wheaton, IL (US); Walter J. Peach, Montgomery, IL (US)

(73) Assignee: Standard Car Truck Company, Rosemont, IL (US)

( * ) Notice: Subject to any disclaimer, the term of this patent is extended or adjusted under 35 U.S.C. 154(b) by 420 days.

(21) Appl. No.: 15/290,782

(22) Filed: Oct. 11, 2016

(65) Prior Publication Data

US 2017/0129510 A1 May 11, 2017

Related U.S. Application Data

(60) Provisional application No. 62/251,381, filed on Nov. 5, 2015.

(51) Int. Cl.
*B61F 15/20* (2006.01)
*B61F 15/12* (2006.01)
(Continued)

(52) U.S. Cl.
CPC ..... *B61F 15/20* (2013.01); *B61F 5/32* (2013.01); *B61F 15/12* (2013.01); *B61F 15/28* (2013.01)

(58) Field of Classification Search
CPC .... B61F 5/26; B61F 15/12; B61F 5/50; B61F 5/32
See application file for complete search history.

(56) References Cited

U.S. PATENT DOCUMENTS 2,207,848 A 7/1940 Barrrows
3,274,955 A 9/1966 Thomas
(Continued)

FOREIGN PATENT DOCUMENTS

WO WO 2015/103075 7/2015

OTHER PUBLICATIONS

Standard Car Truck, A Wabtec® Company, S-2 Barber Stabilized Truck Component Advertisement, (Available prior to Nov. 5, 2015), (1 page).

(Continued)

*Primary Examiner* — Jason C Smith
(74) *Attorney, Agent, or Firm* — Neal, Gerber & Eisenberg LLP

(57) ABSTRACT

A railroad car bearing adapter assembly configured to be employed in combination with a high warp restraint truck (with or without an auxiliary or original warp restraint system), and including a low profile thickness and relatively longitudinally narrow roller bearing adapter, a low profile adapter shear pad with a shear stiffness in a range of 85,000 lbs/in to 125,000 lbs/inch, and side wear pad that in combination total clearance in a range of 0.09 inches to 0.36 inches between the side frame thrust lugs and the adapter with the side wear pads. This overall combination reduces wheel wear and damage, reduces fuel consumption, reduces the need for railroad track repair, improves high speed stability and curving performance for both empty cars and loaded cars, provides more truck stability under a loaded car in shallow curves and while encountering certain perturbations, and provides optimum curving performance that enables the axles to better align with curves of relatively high degrees.

24 Claims, 25 Drawing Sheets

(51) Int. Cl.
*B61F 5/32* (2006.01)
*B61F 15/28* (2006.01)

(56) References Cited

U.S. PATENT DOCUMENTS

| | | | |
|---|---|---|---|
| 3,276,395 | A | 10/1966 | Heintzel |
| 3,381,629 | A | 5/1968 | Jones |
| 3,699,897 | A | 10/1972 | Sherrick |
| 3,785,298 | A | 1/1974 | Reynolds |
| 4,236,457 | A | 12/1980 | Cope |
| 4,433,629 | A | 2/1984 | Roush, Jr. |
| 4,552,074 | A | 11/1985 | Mulcahy et al. |
| 5,009,521 | A | 4/1991 | Wiebe |
| 5,404,826 | A | 4/1995 | Rudibaugh et al. |
| 5,509,358 | A | 4/1996 | Hawthorne et al. |
| 5,562,045 | A | 10/1996 | Rudibaugh et al. |
| 5,572,931 | A | 11/1996 | Lazar et al. |
| 5,746,137 | A | 5/1998 | Hawthorne et al. |
| 5,794,538 | A | 8/1998 | Pitchford |
| 5,799,582 | A | 9/1998 | Rudibaugh et al. |
| 5,918,547 | A | 7/1999 | Bullock et al. |
| 6,178,894 | B1 | 1/2001 | Leingang |
| 6,234,083 | B1 | 5/2001 | Tack, Jr. |
| 6,347,588 | B1 | 2/2002 | Leingang |
| 6,422,155 | B1 | 7/2002 | Heyden et al. |
| 6,439,130 | B1 | 8/2002 | Scheffel |
| 6,524,681 | B1 | 2/2003 | Seitz et al. |
| 6,591,759 | B2 | 7/2003 | Bullock |
| 6,688,236 | B2 | 2/2004 | Taillon |
| 6,792,874 | B1 | 9/2004 | Anderson et al. |
| 6,874,426 | B2 | 4/2005 | Forbes |
| 7,017,498 | B2 | 3/2006 | Berg et al. |
| 7,121,212 | B2 | 10/2006 | Schorr et al. |
| 7,174,837 | B2 | 2/2007 | Berg et al. |
| 7,255,048 | B2 | 8/2007 | Forbes |
| 7,328,659 | B2 | 2/2008 | Forbes |
| 7,387,074 | B2 | 6/2008 | Myers |
| 7,497,169 | B2 | 3/2009 | Forbes |
| 7,513,199 | B2 | 4/2009 | Van Auken |
| 7,699,008 | B2 | 4/2010 | Forbes |
| 7,739,961 | B2 | 6/2010 | East et al. |
| 7,845,288 | B2 | 12/2010 | Forbes et al. |
| 7,946,229 | B2 | 5/2011 | Forbes et al. |
| 7,966,946 | B1 | 6/2011 | Novak et al. |
| 8,474,383 | B1 | 7/2013 | Berg et al. |
| 8,720,347 | B2 | 5/2014 | Forbes et al. |
| 8,893,626 | B2 | 11/2014 | Berg et al. |
| 2005/0268813 | A1* | 12/2005 | Van Auken ..... B61F 5/305 105/218.1 |
| 2009/0158957 | A1 | 6/2009 | East et al. |
| 2010/0199880 | A1* | 8/2010 | East ..... B61F 5/305 105/224.1 |
| 2012/0186486 | A1* | 7/2012 | Tavares ..... B61F 5/32 105/224.1 |
| 2014/0060380 | A1* | 3/2014 | Berg ..... B61F 5/305 105/218.1 |
| 2014/0318412 | A1 | 10/2014 | East et al. |
| 2017/0129510 | A1* | 5/2017 | Golembiewski ..... B61F 15/12 |

OTHER PUBLICATIONS

Standard Car Truck, A Wabtec® Company, Truck Components Advertisement, (Available prior to Nov. 5, 2015), (1 page).
Standard Car Truck, A Wabtec® Company, Shear Pads and Pedestal Roof Shims Advertisement, (Available prior to Nov. 5, 2015), (1 page).
Freight Catalog,www.wabtec.com, Truck Components, Barber S2-86® Radial Adapter Advertisement, (Available prior to Nov. 5, 2015), (1 page).
Adaptor Plus Steering Pad System, Amsted Rail, from website: http://www.amstedrail.com/adapter-plus-steering-pad-system, printed Mar. 12, 2013, (Available prior to Nov. 5, 2015), (1 page).
Truck Assemblies, Amsted Rail, from website: http://www.amstedrail.com/content/truck-assemblies, printed Mar. 12, 2013, (Available prior to Nov. 5, 2015), (2 pages).
Standard Car Truck Company, Pedestal Roof Wear Liners, from website: http://sctco.com/8-5_6.html, printed Feb. 26, 2013, (Available prior to Nov. 5, 2015), (2 pages).
Standard Car Truck, A Wabtec® Company, Barber S2-86 Radial Adapter Advertisement, (Available prior to Nov. 5, 2015), (1 page).
2015 AAR Office Manual—Rule 88, (Revised Jul. 1, 2015), (20 pages).
AAR Manual of Standards and Recommended Practices Trucks and Truck Details, "Truck Performance for Rail Cars: Specification M-976", pp. 1-8. (Last Revised: 2013), (12 pages).
AAR Manual of Standards and Recommended Practices Trucks and Truck Details, "Chapter 11 Service—Worthiness Tests and Analysis for New Freight Cars", (Available prior to Nov. 5, 2015), (20 pages).
Korean Intellectual Property Office as International Searching Authority, International Search Report and Written Opinion, dated Feb. 8, 2017, in co-pending PCT Application No. PCT/US2016/059653 (22 pages).

* cited by examiner

RAILROAD CAR ROLLER BEARING ADAPTER ASSEMBLY

PRIORITY CLAIM

This application claims priority to and the benefit of U.S. provisional patent application Ser. No. 62/251,381, filed Nov. 5, 2015, entitled "Railroad Car Roller Bearing Adapter Assembly", the entire contents of which are incorporated herein by reference.

BACKGROUND

Conventional freight railroad cars in North America and other parts of the world typically include a car body and two spaced apart trucks. The car body or car body under frame typically includes two spaced apart center plates that respectively rest on and are rotatably or swivelly received by bolster bowls of the two trucks. The trucks rollingly support the car body along railroad tracks or rails. Each truck typically has a three piece truck configuration that includes two spaced apart parallel side frames and a bolster. The side frames extend in the same direction as the tracks or rails, and the bolster extends transversely or laterally to the tracks or rails. The bolster extends laterally through and between and is supported by the two spaced apart side frames. Each side frame typically defines a center opening and pedestal jaw openings on each side of the center opening. Each end of each bolster is typically supported by a spring group positioned in the center opening of the side frame and supported by the lower portion of the side frame that defines the center opening.

Each truck also typically includes two axles that support the side frames, four wheels, and four roller bearing assemblies respectively mounted on the ends of the axles. The truck further typically includes four bearing adapters respectively positioned on each roller bearing assembly in the respective pedestal jaw opening below the downwardly facing wall of the side frame that defines the top of the pedestal jaw opening. The wheel sets of the truck are thus received in bearing adapters placed in leading and trailing pedestal jaws in the side frames, so that axles of the wheel sets are generally parallel. The bearing adapters permit relatively slight angular adjustment of the axles. The spring sets permit the side frames to partially move with respect to the bolster, about longitudinal, vertical, and transverse axes.

Directions and orientations herein refer to the normal orientation of a railroad car in use. Thus, unless the context clearly requires otherwise, the "longitudinal" axis or direction is substantially parallel to the tracks or rails and in the direction of movement of the railroad car on the tracks or rails in either direction. The "transverse" or "lateral" axis or direction is in a substantially horizontal plane and is substantially perpendicular to the longitudinal axis and the tracks or rails. The term "inboard" means toward the center of the railroad car, and may mean inboard in a longitudinal direction, a lateral direction, or both. Similarly, "outboard" means away from the center of the railroad car. "Vertical" is the up-and-down direction, and "horizontal" is in a plane parallel to the tracks or rails including the transverse and longitudinal axes. A truck is considered "square" when its wheels are aligned on parallel tracks or rails and the axles are parallel to each other and perpendicular to the side frames. The "leading" side of the truck means the first side of a truck on a railroad car to encounter a turn; and the "trailing" side is opposite the leading side.

Roller bearing adapter assemblies including an adapter shear pad and mating roller bearing adapter have long been known in railroad car trucks for supporting the truck side frames on the wheel sets. Each adapter shear pad generally functions to decouple the wheels and axle from the side frame to improve steering of the truck as further explained below. The adapter shear pads must also provide electrical continuity or conductivity between the side frame and the roller bearing adapter (and thus between the car body and the tracks or rails). The electrical continuity or conductivity is needed to ground the car body to eliminate or reduce the buildup of static electricity on the car body. The electrical continuity or conductivity is also needed for the car body or components thereof (such as electric solenoids for doors on bottom dump freight railroad cars) to obtain electrical power or electrical signals from the railroad tracks or rails. In other words, this electric continuity or conductivity is needed to provide electric power or electric signals transmitted from the tracks or rails to one or more components of the car body. The electrical continuity or conductivity is further needed to provide electrical continuity or conductivity between railroad cars to trigger railroad crossing signals.

Such roller bearing adapter assemblies in the past included adapters using metal wear liners that permitted limited lateral and longitudinal movement of the side frames relative to the roller bearing adapters positioned on the wheel sets under loaded car due to high frictional resistance.

Subsequently, elastomeric mountings took the place of the metal wear liners to provide controlled flexibility in all directions, particularly for passive-steering rail car trucks.

For instance, U.S. Pat. No. 7,387,074 discloses a roller bearing adapter and a partially elastomeric adapter shear pad. This roller bearing adapter is configured to fit on top of the roller bearing and this adapter shear pad is configured to fit on top of the roller bearing adapter. The adapter shear pad is made from an elastomer such as polyurethane.

In another example, U.S. Pat. No. 7,739,961 discloses an improved elastomeric mounting that reduces the thickness from over 1 inch to ½ inch. U.S. Pat. No. 7,739,961 discloses that the adapter shear pad shear stiffness decreases under higher vertical and longitudinal loads.

These and other known roller bearing adapters and adapter shear pads do not fully address the ever increasing and expected future demands for freight car truck performance in the railroad industry. More specifically, while the various current known and commercially available three piece truck configurations with primary suspension pads meet current Association of American Railroads ("AAR") specifications, enhanced specifications are being developed by the AAR and it is expected that the current three piece truck configurations may not meet these new AAR specifications. These AAR enhanced specifications set forth or codify the continuing and ongoing demands in the railroad industry for improved freight car truck performance to: (a) reduce wheel wear and damage; (b) reduce rolling resistance; (c) reduce fuel consumption; (d) reduce the need for and thus cost of railroad track repair (including reducing the cost of rail and tie maintenance); (e) reduce truck hunting and improve high speed stability ("HSS") for both empty and loaded railroad cars; and (f) improve curving performance for both empty and loaded railroad cars.

For example, certain known trucks in certain instances may become less stable under a loaded car in shallow curves (such as a 1 degree curve) or while encountering certain rail perturbations.

In other examples, certain known trucks do not provide optimum curving performance, and more specifically, certain known trucks do not enable the axles to optimally align with high degree curves.

More specifically, on straight track or straight rails, a three piece truck with parallel side frames and parallel wheel set axles perpendicular to the side frames (i.e., a substantially perfectly "square" truck) rolls without inducing lateral or transverse forces between the wheel flange and the rail. However, at higher speeds, even minor imperfections or perturbations in the tracks or rails or in the equipment can lead to a condition known as "hunting" that refers to a yawing or oscillating lateral movement of the wheel sets along the rails that causes the railroad car to move side-to-side on the rails. More than minor imperfections or perturbations in the tracks or rails or in the equipment can lead to greater truck hunting even at lower speeds. On trucks with insufficient rigidity, this results in a condition variously known as "warping," "parallelogramming," or "lozenging," wherein the side frames remain parallel, but one side frame moves forward with respect to the other side frame. Trucks with insufficient rigidity can permit hunting. Hunting tends to increase wheel wear and damage, increase fuel consumption, increase the need for railroad track repair, and decrease HSS. In certain instances, hunting has also led to derailments, damage to the lading, and damage to the freight railroad cars.

Curved railroad track or rails poses a different set of challenges for the standard three-piece truck. When a railroad car truck encounters a curve or turn, the distance traversed by the wheels on the outside of the curve is greater than the distance traversed by wheels on the inside of the curve, resulting in lateral and longitudinal forces between the respective wheels and rails. On trucks with insufficient rigidity, they can warp increasing the wheel set angle-of-attack relative to the tracks or rails causing undesirable lateral forces. These wheel forces often cause the wheel set to turn in a direction opposing the curve or turn.

Various current railroad car repair billing indicates that over fifty percent of removals of freight railroad cars from service for repair are related to wheel sets. A majority of these wheel set removals are due to wheel tread damage primarily caused by wear and rolling contact fatigue. In certain instances, surface cracks can form in the tread from large creep forces generated from a wheel set with a high angle of attack. In certain instances, the flanges of the wheels also wear due to inadequate truck steering and/or hunting.

To improve curving performance, it is known to interpose an elastomeric bearing member between the side frame and the tops of the bearing adapters. The elastomeric member: (a) provides, on curved tracks or rails, the wheel sets a limited amount of freedom of movement to depart from a square relationship to respond to turning forces and accommodate the nonparallel condition of the axles (b) provides forces to aid the wheelset to return to a parallel state after the curve and on straight track. The elasticity of the elastomeric bearing member biases the wheel set to return to its square position. To provide the standard three piece truck with the ability to negotiate turns with less rolling resistance, certain known trucks are generally configured to enable a nonparallel condition of the axles during the curve or turn, that is then recovered on the straight tracks or rails. This may be achieved by permitting relative movement of the bearing adapters within the pedestal jaws of the side frames.

It should thus be appreciated that: (a) there are typically competing performance demands for better curving and less truck hunting; (b) many of the truck improvements that facilitate better curving allow more truck hunting; and (c) many of the truck improvements that reduce truck hunting reduce the curving performance. It should also be appreciated that known and proposed three piece trucks are limited in their curving and high speed stability performance.

Accordingly, there is a need to meet these ongoing demands in the railroad industry for improved freight car truck performance, and more specifically to provide a truck that provides better curving while simultaneously reducing truck hunting.

SUMMARY

Various embodiments of the present disclosure provide a high warp restraint railroad truck or car truck having a railroad car roller bearing adapter assembly including a roller bearing adapter, an adapter shear pad, and leading and trailing side wear pads that satisfies various ongoing demands in the railroad industry for improved railroad freight car truck performance. Various embodiments of the present disclosure also provide a high shear stiffness railroad car roller bearing adapter assembly or a railroad car roller bearing adapter assembly including a roller bearing adapter, an adapter shear pad, and leading and trailing side wear pads that in combination with a high warp restraint truck (with or without an auxiliary or integrated warp or integrated restraint system) satisfies various ongoing demands in the railroad industry for improved railroad freight car truck performance. Various embodiments of the present disclosure further provide a new roller bearing adapter, a new adapter shear pad, and new leading and trailing side wear pads.

The high shear stiffness railroad car roller bearing adapter assembly of the present disclosure is configured to be positioned between the side frame pedestal and the roller bearing of a truck of a railroad car. The high shear stiffness railroad car roller bearing adapter assembly of various embodiments of the present disclosure provides the combination of a relatively low profile thickness and relatively longitudinally narrower roller bearing adapter (i.e., in the direction of travel) for enhanced or better curving, a low profile thickness and relatively high shear stiffness adapter shear pad with controlled thrust lug to adapter longitudinal clearance to reduce or inhibit truck hunting and improve curving, and leading and trailing side wear pads that reduce wear between the side frame thrust lugs and the roller bearing adapter. The railroad car roller bearing adapter assembly of the present disclosure is configured to be used in conjunction with a truck of or having a high warp stiffness and/or a standard three piece truck with an auxiliary (i.e., retrofit) or integrated (i.e., original) warp constraint system that provides the truck with relatively higher warp stiffness to further reduce or inhibit truck hunting and improve curving.

In various embodiments, the combination of the present disclosure includes: (1) a relatively low profile thickness and relatively longitudinally narrower roller bearing adapter; (2) a relatively low profile thickness adapter shear pad generally structurally configured in a somewhat same general manner as the adapter shear pad disclosed in U.S. Pat. No. 7,739,961 but that has an increased shear stiffness range between 85,000 and 125,000 lbs/inch; and (3) the leading and trailing side wear pads, wherein: (a) the combination of the roller bearing adapter, the adapter shear pad, and the two opposing leading and trailing side wear pads provide a side frame thrust lug to adapter total clearance range of 0.09 inches to 0.36 inches; and (b) the roller bearing adapter, the adapter shear pad, and the side wear pads are employed in combination with a high warp restraint truck (with or without an auxiliary or integrated warp restraint system).

This combination of components enhances or provides better curving while simultaneously inhibiting or reducing truck hunting. By providing enhanced or better curving and inhibiting truck hunting, this overall combination of the present disclosure: (a) reduces wheel wear and damage; (b) reduces rolling resistance; (c) reduces fuel consumption; (d) reduces the cost of railroad track repair (including reducing the costs of rail and tie maintenance); (e) improves high speed stability ("HSS") including at speeds at or greater than 70 miles per hour for both empty and loaded railroad cars; (f) provides more truck stability under a loaded car in shallow curves (such as a 1 degree curve); (g) provides more truck stability while encountering certain perturbations; and (h) enables the axles to align or steer better in curves.

This combination of components provides leading and trailing side wear pads that substantially minimize wear, maintaining the thrust lug/adapter clearance. In other words, this combination of components provides a side frame thrust lug to adapter clearance that is configured to not increase substantially due to wear from metal-to-metal contact. It should be appreciated that the use of the term "side frame thrust lug adapter clearance" refers herein to the clearance between the lugs and the leading and trailing surfaces of the respective leading and trailing side wear pads.

This combination of components reduces the overall deflection of the adapter shear pad that increases the longevity of the adapter shear pad. In other words, the combined components reduce the amount or likelihood of the shear pad deflection over the design limit, and thus increase the longevity of the shear pad.

This combination of components of the present disclosure is also relatively cost efficient.

In further embodiments of the present disclosure, the roller bearing adapter, the adapter shear pad, and the leading and trailing side wear pads are also employed on a railcar with constant contact side bearings to minimize hunting to keep the truck more stable at high speeds.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
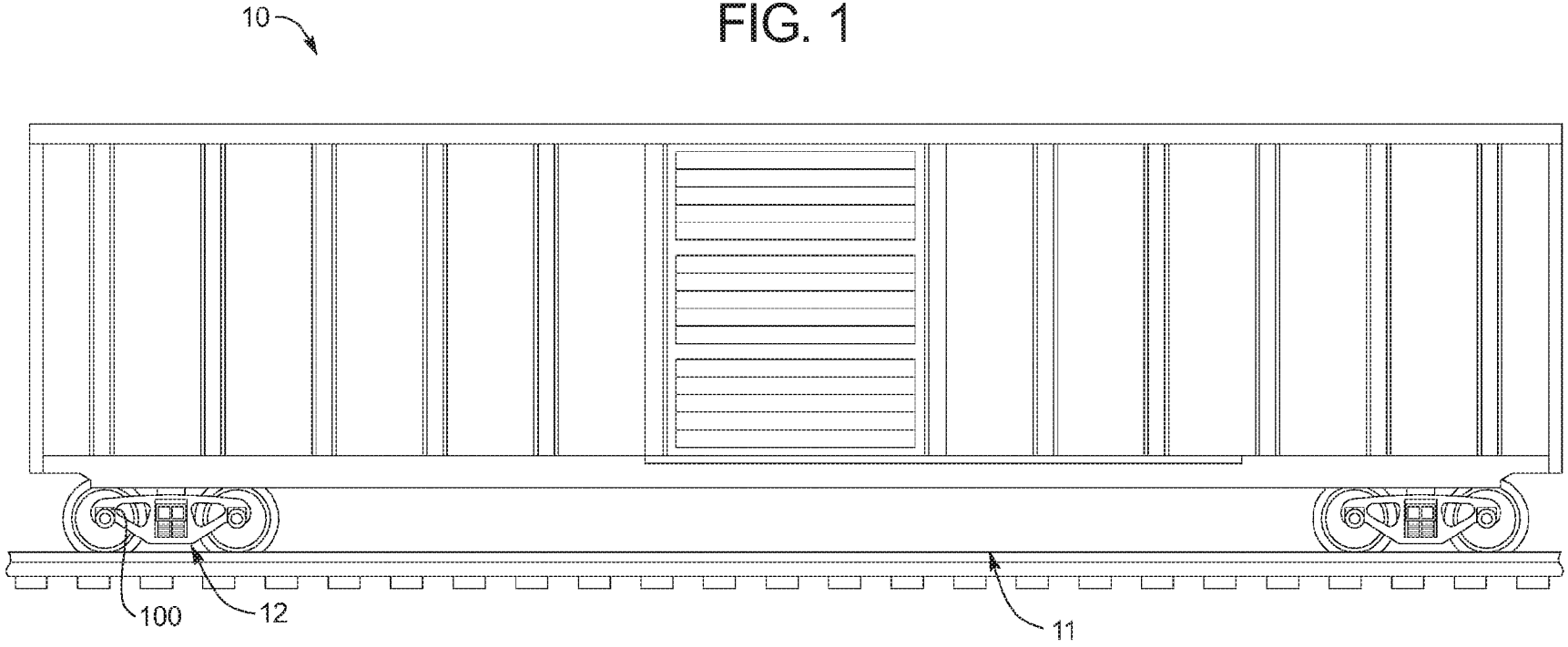
FIG. 1 is a side view of a conventional freight railroad car positioned on conventional railroad tracks or rails.
Figure 2:
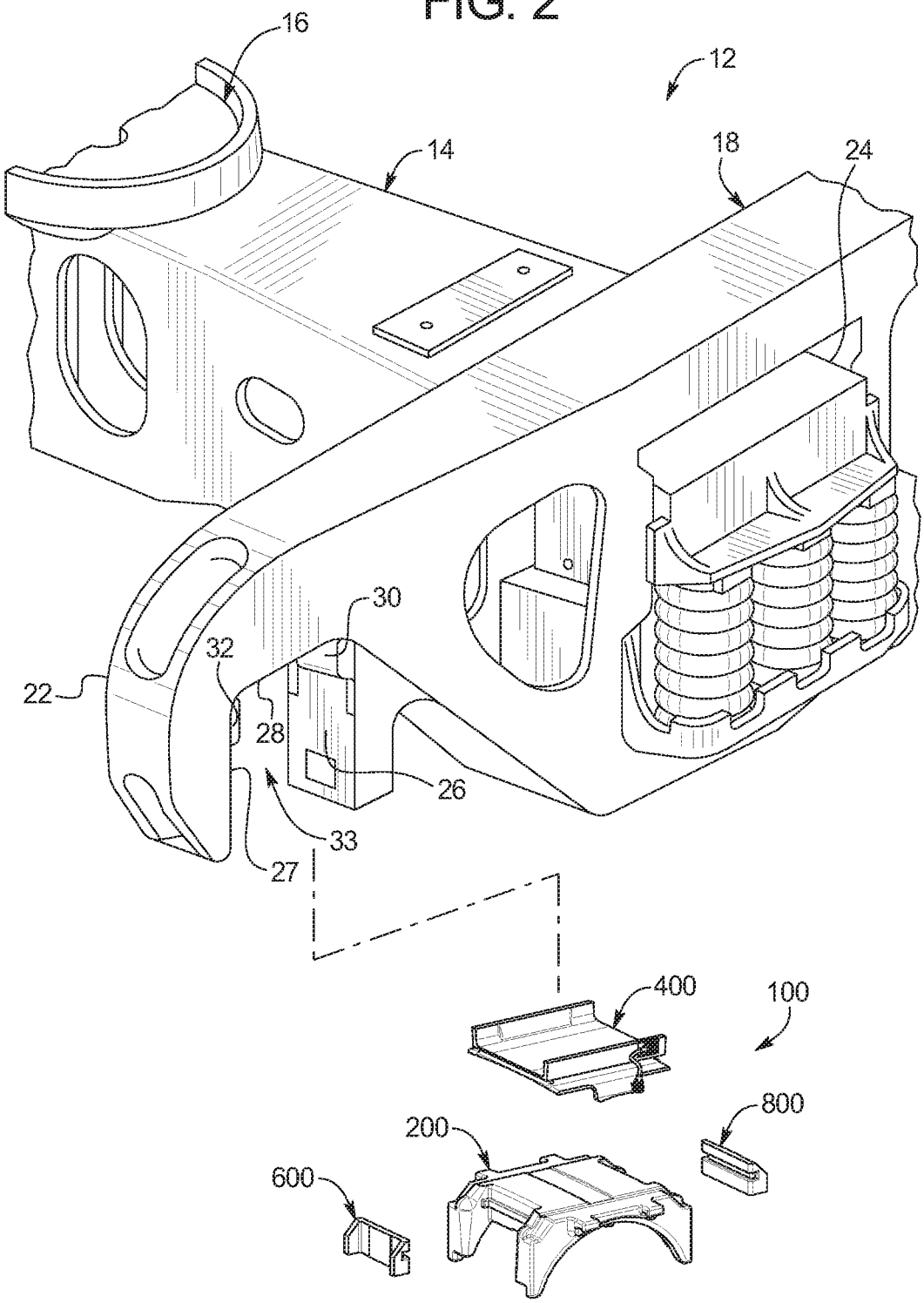
FIG. 2 is a perspective view of a bolster bowl (shown in fragmentary), a bolster (shown in fragmentary), and a side frame (shown in fragmentary) of a freight railroad car truck, and an exploded top perspective view of a railroad car roller bearing adapter assembly of one example embodiment of the present disclosure, and illustrating the roller bearing adapter, the adapter shear pad, and the leading and trailing side wear pads of the railroad car roller bearing adapter assembly.

Referring now to the drawings and particularly to FIGS. 1, 2, 3, 4, 5, 6, 7, 8, 9, and 10, one example embodiment of the roller bearing adapter assembly of the present disclosure that is generally indicated by numeral 100 is shown with respect to a freight railroad car 10 and specifically with respect to a truck 12 of a freight railroad car 10 configured to roll along railroad tracks or rails 11. In this example illustration, the truck 12 includes a bolster 14 (shown in fragmentary in FIG. 2), a bolster center bowl 16 (shown in fragmentary in FIG. 2) on the bolster 14, and a side frame 18 (shown in fragmentary in FIG. 2). Generally, the bolster 14 extends transversely or laterally to the direction of the railroad tracks or rails 11 and the side frame 18 extends longitudinally in the same direction as the railroad tracks or rails 11. The side frame 18 includes two downwardly extending pedestal jaws including a first pedestal jaw 22 and a second pedestal jaw (not shown) on the opposite side of the center opening 24 of the side frame 18. The first pedestal jaw 22 includes an inside wall 26, a top wall or pedestal roof 28, and an outside wall 27 that generally define the pedestal jaw opening 33. The first pedestal jaw 22 also includes an inner thrust lug 30 (partially shown in FIG. 2) at the intersection of the inside wall 26 and the top wall 28, and an outer thrust lug 32 (partially shown in FIG. 2) at the intersection of the outside wall 27 and the top wall or pedestal roof 28. Although not shown, the truck 12 includes other conventional components as will be readily appreciated by one of ordinary skill in the art.

Figure 3:
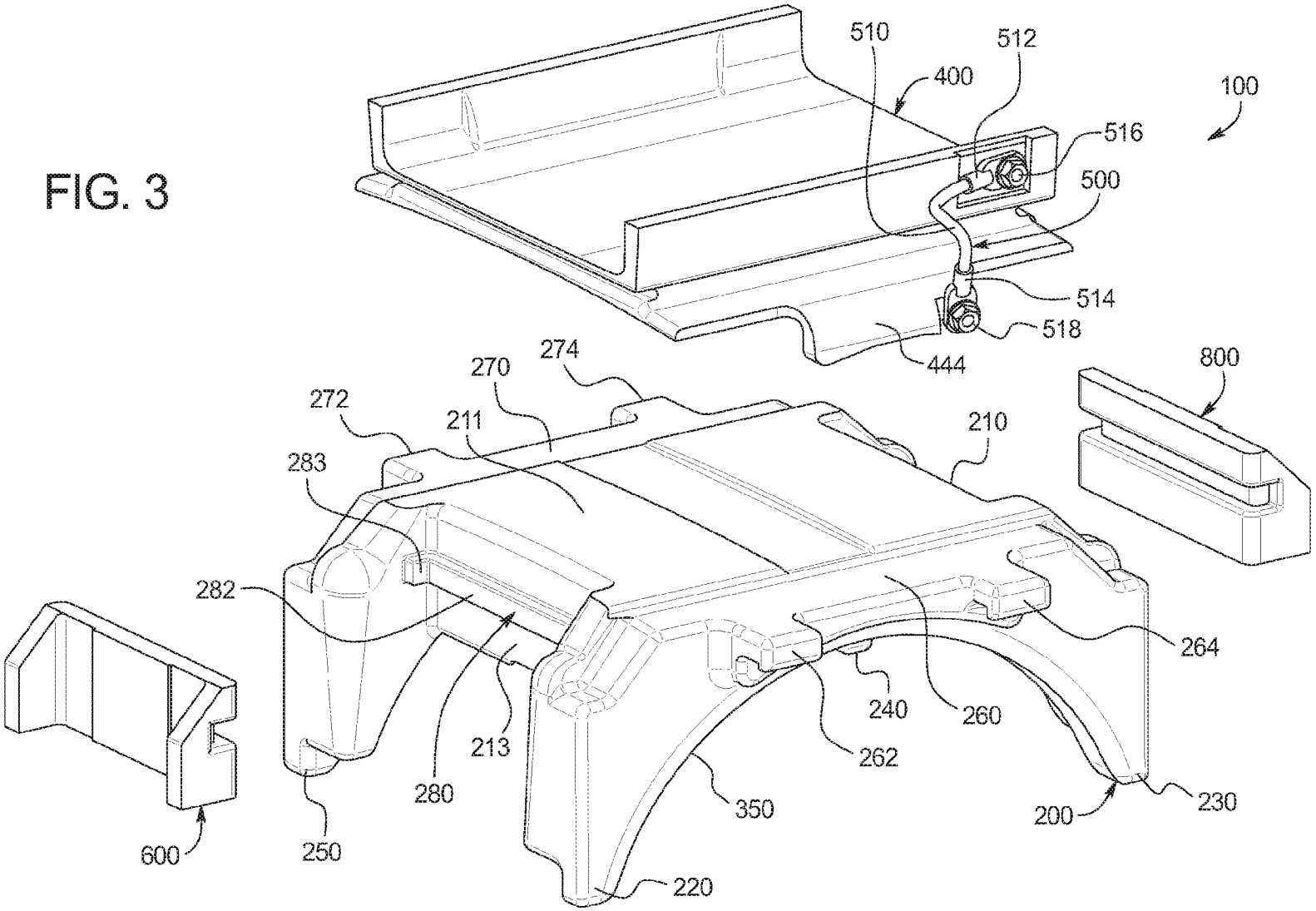
FIG. 3 is an enlarged exploded top perspective view of the railroad car roller bearing adapter assembly of FIG. 2, and illustrating the roller bearing adapter, the adapter shear pad, and the two side wear pads of the railroad car roller bearing adapter assembly.
Figure 5:
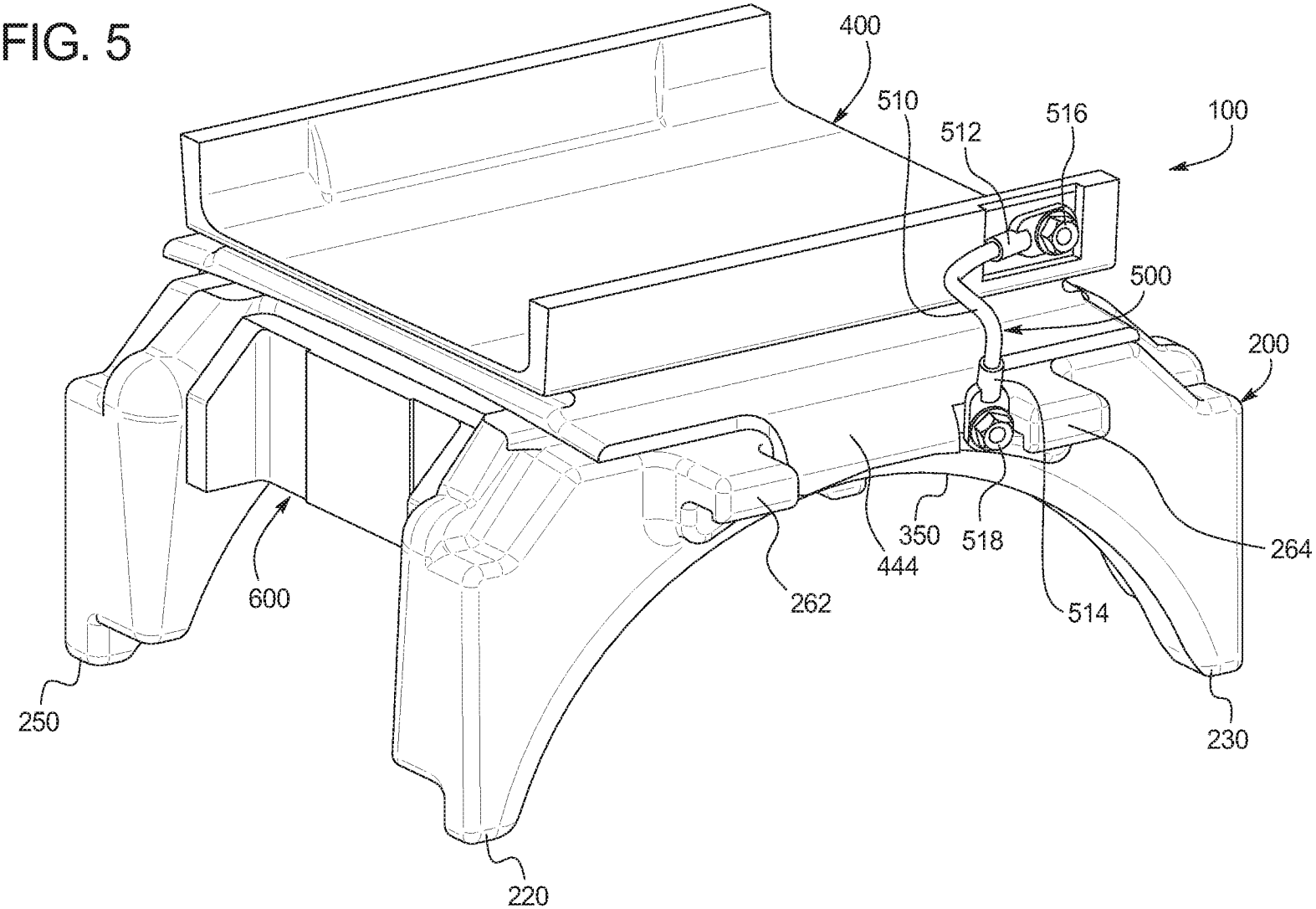
FIG. 5 is an enlarged top perspective view of the assembled railroad car roller bearing adapter assembly of FIG. 2, and illustrating the roller bearing adapter, the adapter shear pad, and one of the two side wear pads of the railroad car roller bearing adapter assembly.
Figure 6:
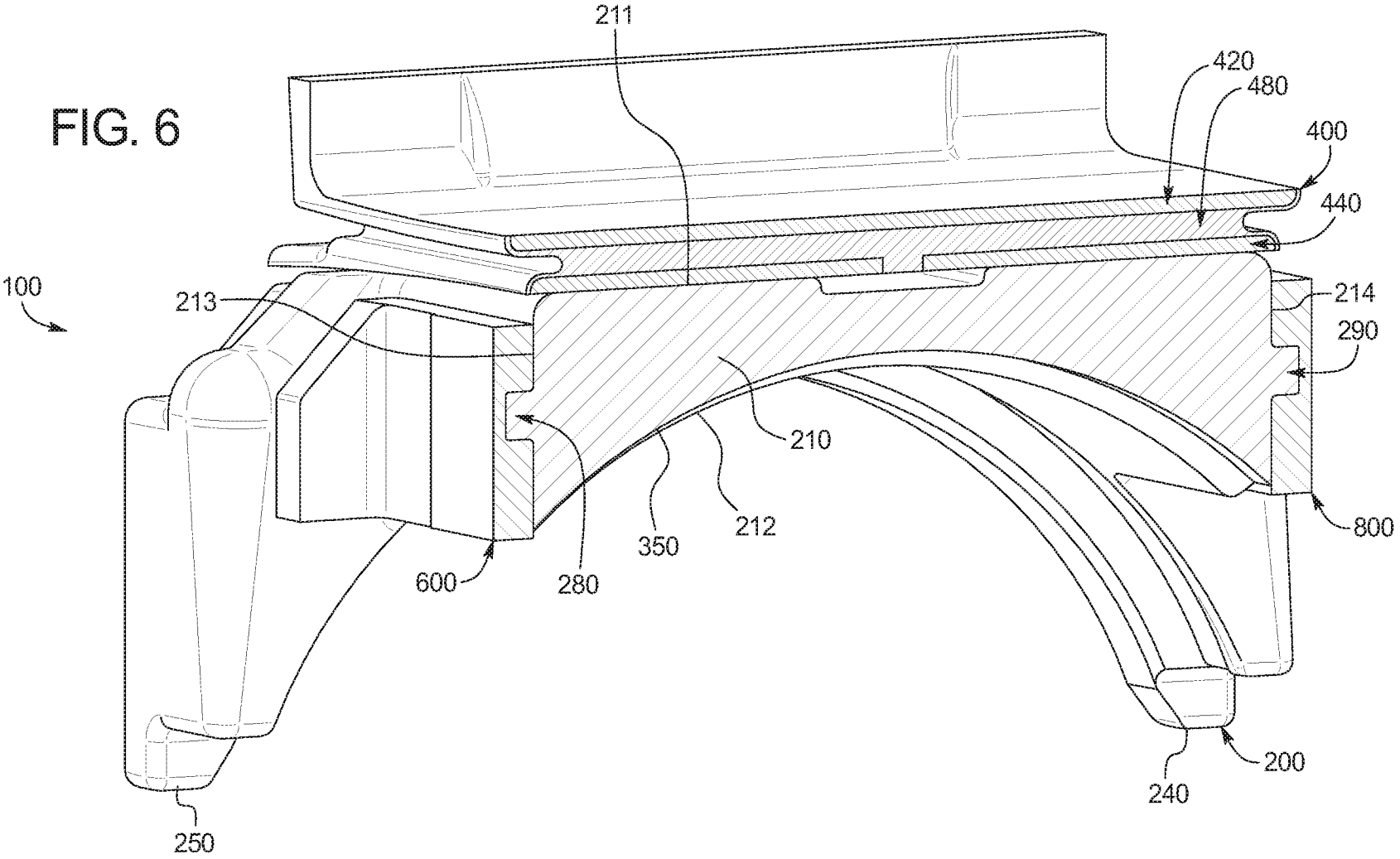
FIG. 6 is an enlarged perspective cross-sectional view of the assembled railroad car roller bearing adapter assembly of FIG. 2, and illustrating the roller bearing adapter, the adapter shear pad, and the two side wear pads of the railroad car roller bearing adapter assembly.
Figure 7:
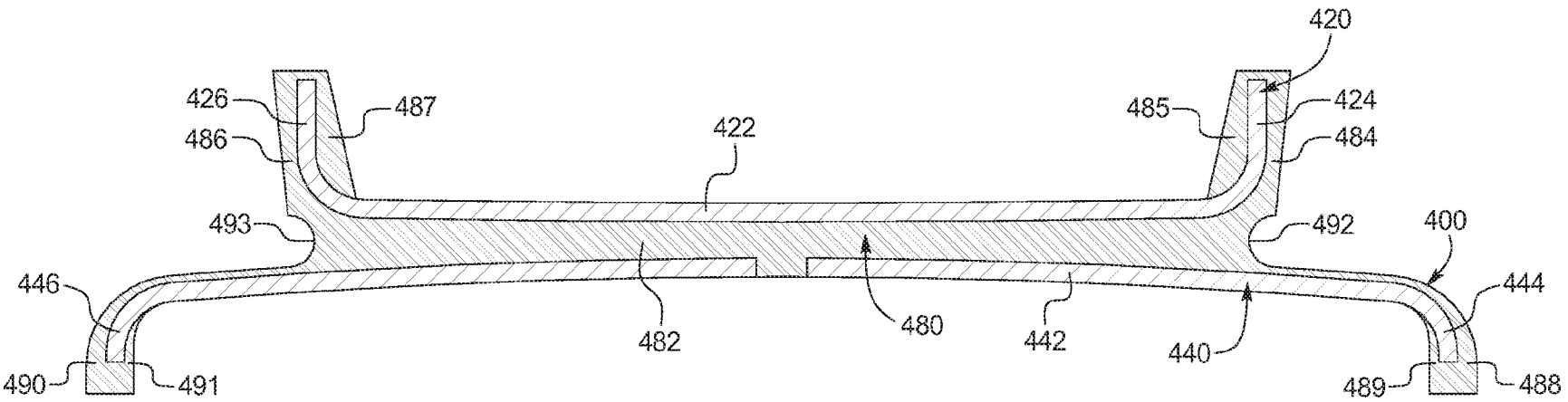
FIG. 7 is an enlarged cross-sectional view of the adapter shear pad of the railroad car roller bearing adapter assembly of FIG. 2.
Figure 8:
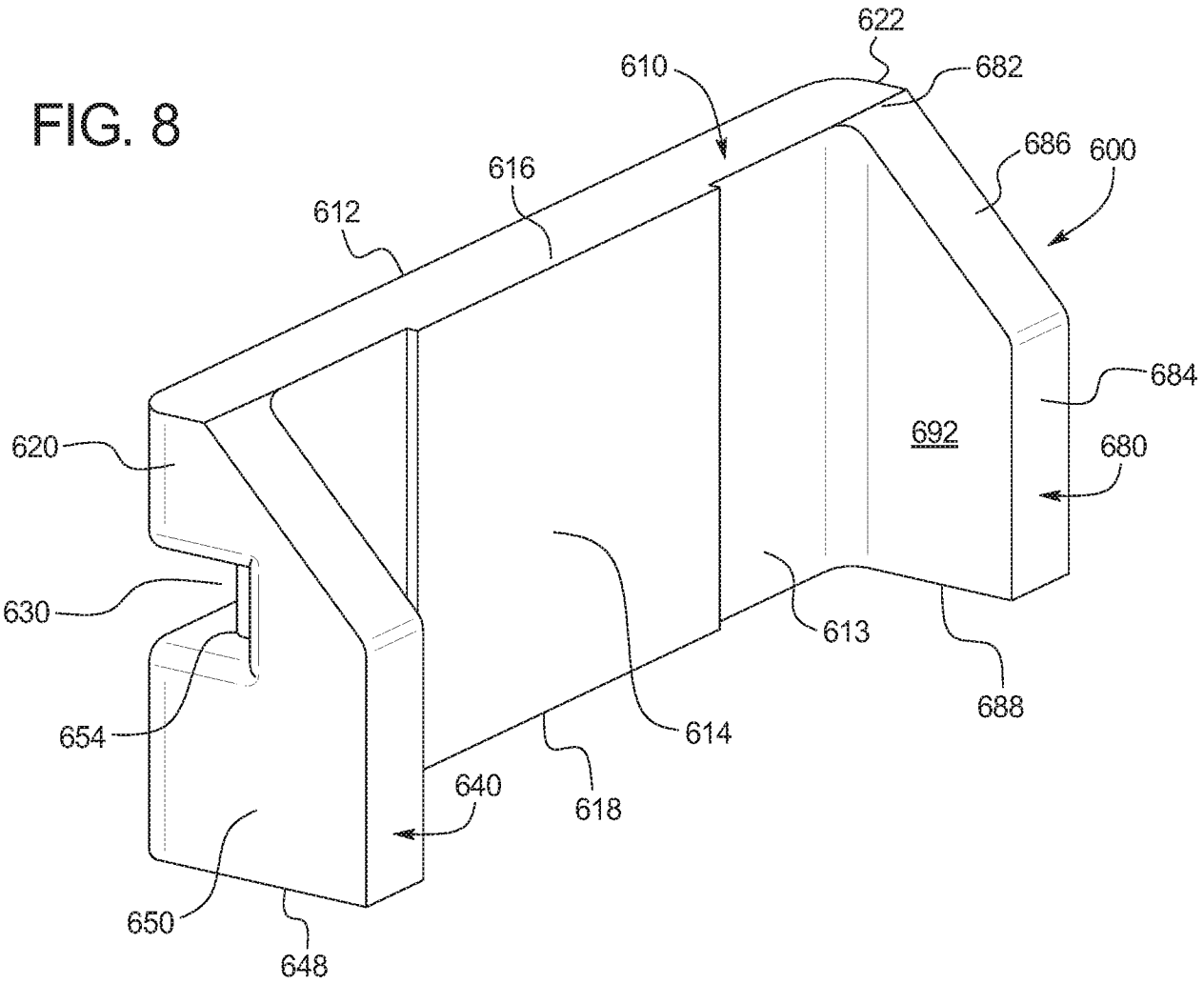
FIG. 8 is an enlarged rear perspective view of one of the side wear pads of the railroad car roller bearing adapter assembly of FIG. 2.
Figure 9:
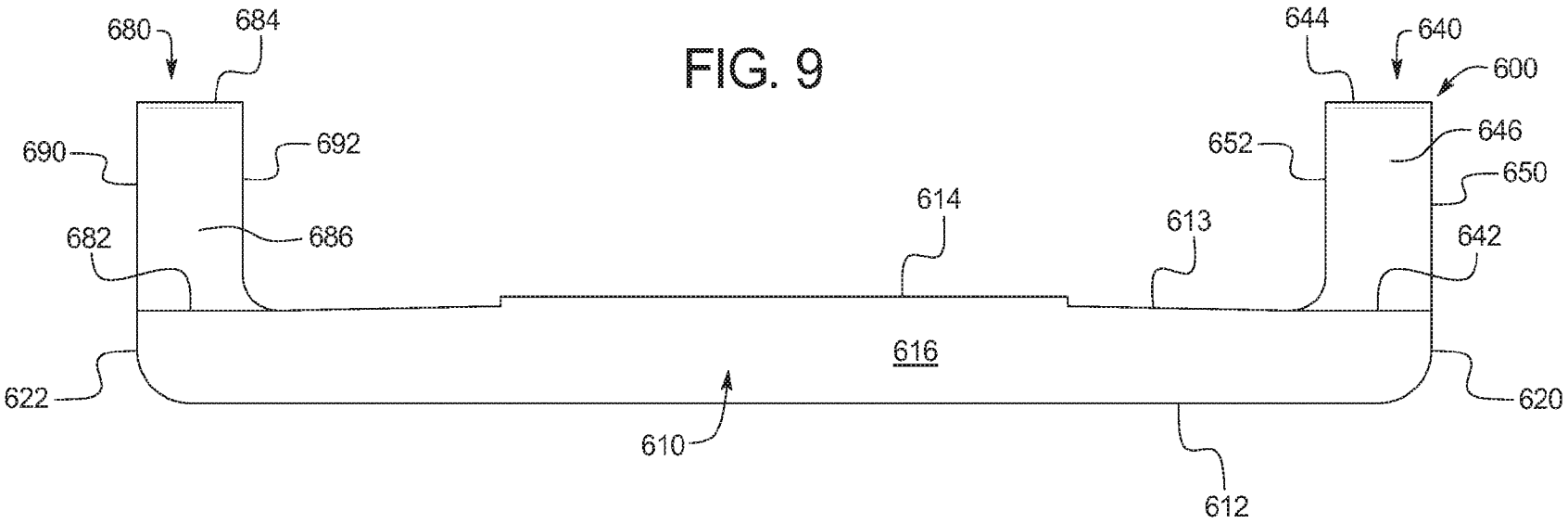
FIG. 9 is an enlarged top view of one of the side wear pads of the railroad car roller bearing adapter assembly of FIG. 2.
Figure 10:
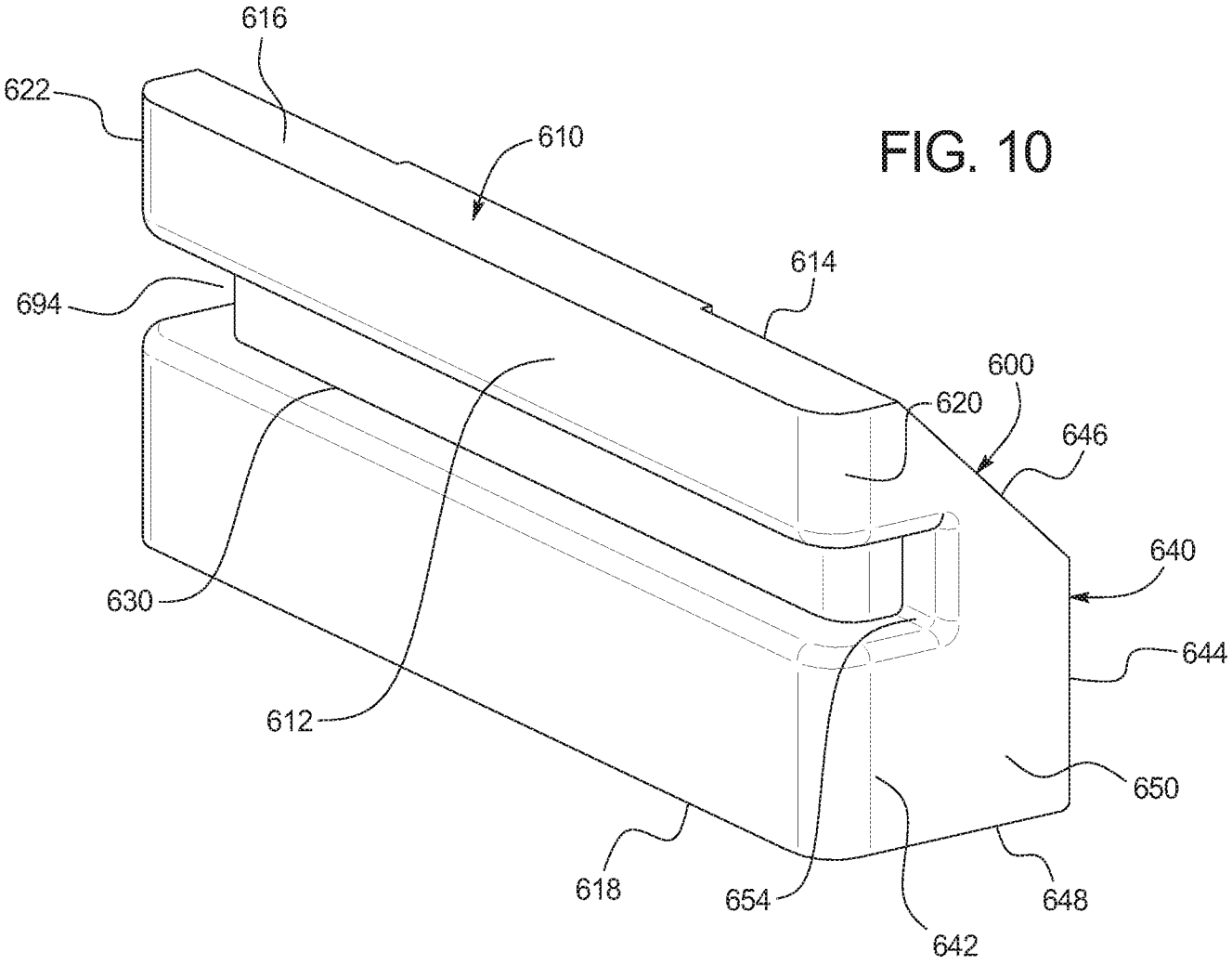
FIG. 10 is an enlarged front perspective view of one of the side wear pads of the railroad car roller bearing adapter assembly of FIG. 2.

The roller bearing adapter assembly 100 is configured to be positioned on a roller bearing (not shown), which in turn, is positioned on wheel set axle (not shown). The roller bearing adapter assembly 100 is configured to be positioned in the pedestal jaw opening 33 adjacent to the top wall or pedestal roof 28, and between the inside wall 26 and the outside wall 27 as further described below. The roller bearing adapter assembly 100 of this illustrated example embodiment of the present disclosure generally includes a roller bearing adapter 200, an adapter shear pad 400, and leading and trailing side wear pads 600 and 800. In this illustrated example embodiment, the side wear pads 600 and 800 are identical, although it should be appreciated that the side wear pads do not need to be identical in accordance with the present disclosure. It should also be appreciated that wear pad 800 could alternatively be the leading side wear pad and wear pad 600 can be the trailing wear pad. The adapter shear pad 400 is configured to be positioned on the roller bearing adapter 200, and the side wear pads 600 and 800 are configured to be removably positioned on, attached to, or connected to opposite sides of the roller bearing adapter 200 as best shown in FIGS. 3, 5, and 6.

It should be appreciated that the roller bearing adapter assembly of each of the embodiments of the present disclosure can be implemented with differently configured side frames and pedestal jaws. It should also be appreciated that the roller bearing adapter assembly of each of the embodiments of the present disclosure is configured to be used in combination with or on a high warp restraint railroad car truck (with or without an auxiliary or integrated warp restraint system). Use of the assembly in conjunction with or on a high warp restraint railroad car truck controls or provides the desired inhibition of truck hunting at high speeds and thus increases high speed stability. It should be appreciated that the inhibition of truck hunting provided by high warp restraint railroad car truck and the inhibition of truck hunting provided by the increased shear stiffness of the shear pad work in combination or combine to substantially offset loss in reduction or control of truck hunting caused by the longitudinally narrower roller bearing adapter and side wear pads that provide for enhanced curving performance as further discussed below.

In this illustrated example embodiment, the roller bearing adapter 200 has a relatively low profile thickness and is relatively narrower in the longitudinal direction than known roller bearing adapters. The roller bearing adapter 200 generally includes a longitudinally and laterally extending body 210, a plurality of legs 220, 230, 240, and 250 respectively integrally connected to and extending downwardly from the four corners of the body 210, and a plurality of extensions 260 and 270 extending in opposite directions laterally or transversely outwardly from the opposite sides of the body 210.

More specifically, the body 210 includes a top surface 211, a bottom surface 212, a first, front or leading surface 213, a second, back or trailing surface 214, a first side surface (not labeled), and a second side surface (not labeled) as best shown in FIGS. 3, 4, 5, and 6. The top surface 211 of the body 210 of the roller bearing adapter 200 is substantially rectangular and generally flat in the longitudinal direction. The top surface 211 of the body 210 is also slightly arcuate in the lateral or transverse direction.

The bottom surface 212 of the body 210 has a generally concave shape extending from the front surface 213 to the back surface 214. The bottom surface 212 of the body 210 and the inner walls of the legs 220, 230, 240, and 250 of the roller bearing adapter 200 partially define a generally arcuate opening 350 configured to receive the roller bearing (not shown). The bottom surface 212 of the body 210 is generally flat in the lateral or transverse direction while curved in the longitudinal direction.

The extensions 260 and 270 have a somewhat reduced height compared to the top surface 211. Spaced apart tabs 262 and 264 protrude or extend from extension 260. Spaced apart tabs 272 and 274 protrude or extend from extension 270. The tabs 262 and 264 are spaced to receive there between the flange 444 of the adapter shear pad 400. The tabs 272 and 274 are spaced to receive there between the flange 446 of the adapter shear pad 400.

The thickness of the body 210 is somewhat reduced compared to a standard roller bearing adapter. The thickness is about 0.80 inches in this illustrated example embodiment. This is approximately 9/32 inches less than various known roller bearing adapters. The reduced thickness of the roller bearing adapter 200 and the adapter shear pad 400 permits the use of an elastomeric adapter shear pad without increasing coupler height when used on standard or conventional side frames configured for snap-on wear liners.

Figure 4:
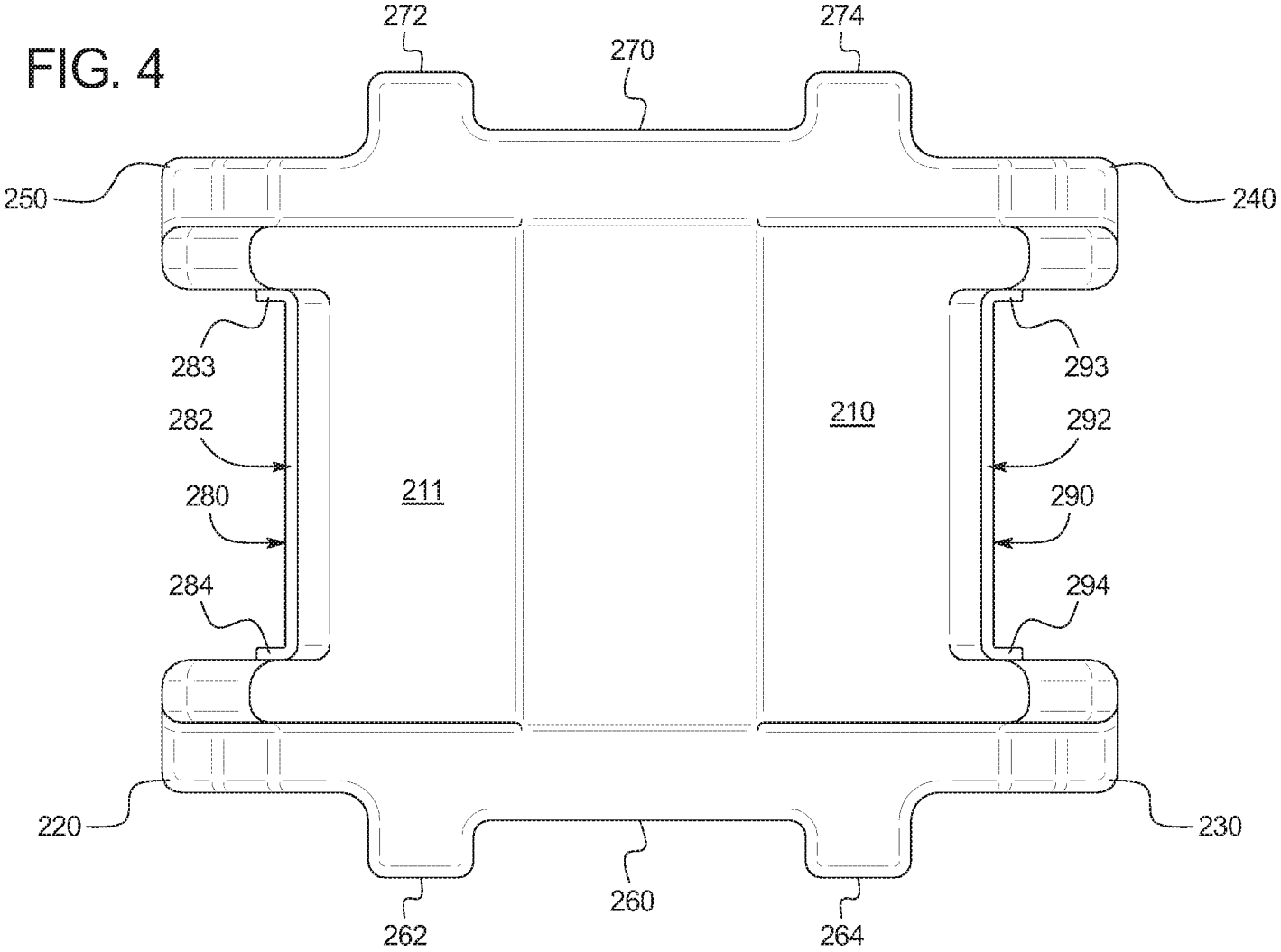
FIG. 4 is an enlarged top view of the roller bearing adapter of the railroad car roller bearing adapter assembly of FIG. 2.

The roller bearing adapter 200 of this illustrated example embodiment includes leading and trailing side wear pad locking mechanisms that are configured to operate or co-act with corresponding leading and trailing locking mechanisms on the leading and trailing side wear pads 600 and 800 to respectively removably connect or attach and secure or lock the side wear pads 600 and 800 to the roller bearing adapter 200 as shown in FIGS. 5 and 6. More specifically, in this illustrated example embodiment, the side wear pad locking mechanisms of the roller bearing adapter 200 include side wear pad locking arms 280 and 290 (as best shown in FIGS. 3 and 4) that are configured to be respectively received in locking pockets in the side wear pads 600 and 800 to attach and lock the side wear pads 600 and 800 to the roller bearing adapter 200 as further discussed below. The locking arm 280 includes a central section 282 extending outwardly forwardly from the first or front surface 213, a first side section 283 extending transversely from the inner surface of the leg 250, and a second side section 284 extending transversely from the inner surface of leg 220 such that the first side section 283 and the second side section 284 extend toward each other. The locking arm 290 includes a central section 292 extending outwardly rearwardly from the second or back surface 214, a first side section 293 extending transversely from the inner surface of the leg 240, and a second side section 294 extending transversely from the inner surface of leg 230 such that the first side section 293 and the second side section 294 extend toward each other. In this illustrated embodiment, the locking arms 280 and 290 have a generally rectangular cross section; however, it should be appreciated that they can be otherwise suitably shaped and sized in accordance with the present disclosure.

In this illustrated example embodiment, the roller bearing adapter 200 is a unitary cast ductile iron structure, although it can be formed in other suitable manners and from other suitable materials in accordance with the present disclosure. It should also be appreciated that the roller bearing adapter of the present disclosure can be implemented with differently configured roller bearings.

Most standard or conventional side frames in North America and other parts of the world designed for 100 or 110 ton capacity, the distance between thrust lugs is 7.75 inches and the longitudinal distance of the body of the roller bearing from the leading side to the trailing side is 7.656 inches.

To increase the clearance between the thrust lugs 30 and 32 and the roller bearing adapter 200, the "as manufactured" nominal longitudinal dimension of the body (i.e., in the direction of travel) of the roller bearing adapter is decreased from the conventional 7.656 inches to a combined "as manufactured" nominal longitudinal dimension of the body 210 of the roller bearing adapter 200 and the wear pads to 7.50 inches in this illustrated embodiment. In other words, the body 210 and both wear pads have a 7.50 inch longitudinal dimension. As further discussed below, the side wear pads in this illustrated embodiment will range from ⅛ to ⅜ inch thick (i.e., from leading side surface to trailing side surface), and thus the gaps between the respective leading and trailing outer surfaces of the side wear pads and lugs range from 0.045 inches to 0.18 inches.

The additional thrust clearance between the lugs 30 and 32 and combination of the side wear pads 600 and 800 and roller bearing adapter 200 provided by the assembly of the present disclosure enables greater wheel set displacement and radial wheel set alignment when negotiating a curved track or rails. In other words, when the railroad car truck encounters a curve or turn, this additional thrust lug clearance enables the wheelset to yaw or rotate more so reducing the angle-of-attack relative to the rail resulting in less undesired lateral and longitudinal forces between the respective wheels and rails. This greater wheel set radial alignment reduces rolling resistance and wheel flange wear and damage.

The side frame thrust lug to roller bearing adapter clearance also can affect the overall deflection of the shear pad. Excessive deflection decreases the longevity of the shear pad; and therefore, the thrust lug and adapter clearance must not considerably increase due to wear from metal-to-metal contact. The leading and trailing side wear pads 600 and 800 are configured to substantially minimize such wear and thus substantially maintain the desired clearance. Thus, the present disclosure provides relatively constant thrust lug to adapter clearance that greatly aids in adapter shear pad longevity.

The adapter shear pad 400 has a relatively low profile thickness and a relatively high shear stiffness in this illustrated embodiment. The adapter shear pad 400 generally includes an upper plate 420, a lower plate 440, an elastomeric connector 480 connecting the upper plate 420 and the lower plate 440, and a grounding strap 500 connected to the upper plate 420 and connected to the lower plate 440 (as best shown in FIGS. 3, 5, 6, and 7). The adapter shear pad 400 is configured in a similar manner to the adapter shear pad described in U.S. Pat. No. 7,739,961 that is incorporated herein by reference. However, the adapter shear pad 400 of the present disclosure has a substantially greater shear stiffness for both longitudinal and lateral directions for a loaded railroad car application than the adapter shear pad disclosed in U.S. Pat. No. 7,739,961. As further discussed below, the shear stiffness for both longitudinal and lateral directions are about equal and within a preferred range of 85,000 to 125,000 lbs/in for a loaded railroad car application in this illustrated embodiment as opposed to the substantially lower 25,000 to 40,000 lbs/in shear stiffness for the adapter shear pad disclosed in U.S. Pat. No. 7,739,961.

More specifically, the upper plate 420 has a generally U-shaped body 422 with upturned side edges or flanges 424 and 426. The upper plate 420 forms a seat or engagement surface for the side frame pedestal roof 28. The upper plate 420 has a slightly arched or curved configuration from side to side or transversely. The upper plate 420 is formed of AISI 1045 steel in this illustrated embodiment. However, it should be appreciated that the upper plate can be made from other suitable materials. The upper plate 420 has a thickness of approximately 0.125 inches in this illustrated embodiment. It should also be appreciated that the upper plate can be made in other suitable sizes and shapes.

The lower plate 440 has a generally upside down U-shaped body 442 with downturned side tab or flanges 444 and 446. The tab or flange 444 fits between mating tabs 262 and 264 of the roller bearing adapter 200 for positioning the adapter shear pad 400 with respect to the roller bearing adapter 200. The tab or flange 446 fits between mating tabs 272 and 274 of the roller bearing adapter 200 for positioning the adapter shear pad 400 with respect to the roller bearing adapter 200. The lower plate 440 has a slightly arched or curved configuration from side to side or transversely. The lower plate 440 is formed of AISI 1045 steel in this illustrated embodiment. However, it should be appreciated that the lower plate can be made from other suitable materials. The lower plate 440 has a thickness of approximately 0.125 inches inch in this illustrated embodiment. It should also be appreciated that the lower plate can be made in other suitable sizes and shapes.

The upper plate 420 and the lower plate 440 of the adapter shear pad 400 in this illustrated example embodiment are connected by an elastomeric connector 480. The space between the upper and lower plates 420 and 440 is filled by a longitudinally and laterally extending body 482 of the elastomeric connector 480. The body 482 of the elastomeric connector has a thickness of 0.25 inches in this illustrated embodiment. In this illustrated embodiment, the main section of the adapter shear pad 400 has a total thickness of approximately 15/32 inches at the center in an uncompressed condition. This is significantly thinner than various known adapter shear pads that satisfy the AAR performance requirements in existence since 2002. For example, certain known shear pads have an upper plate with a 0.25 inch thickness, and a lower plate with a 3/8 inch thickness and a total thickness of approximately 1.06 inch.

The elastomeric connector 480 has: (1) a first hand 484 that extends from the body 482 up onto the flange 424 of the upper plate 420 and a first finger 485 that extends over and on the inside surface of the flange 424 of the upper plate 420; (2) a second hand 486 that extends from the body 482 up onto the flange 426 of the upper plate 420 and a second finger 487 that extends over and on the inside surface of the flange 426 of the upper plate 420; (3) a third hand 488 that extends from the body 482 down onto the flange 444 of the lower plate 440 and a third finger 489 that extends under and on the inside surface of the flange 444 of the lower plate 440; and (4) a fourth hand 490 that extends from the body 482 down onto the flange 446 of the lower plate 440 and a fourth finger 491 that extends under and on the inside surface of the flange 446 of the lower plate 440.

The longitudinal edges or ends 492 and 493 of the body 482 of the elastomeric connector 480 each have an outer concave curvature. In this illustrated embodiment, the radius of the curvature is about 0.15 inches, although it should be appreciated that other suitable sizes will prohibit the rubber from expanding into tension may be employed in accordance with the present disclosure.

The transverse edges or ends of the body 482 of the elastomeric connector 480 are formed such that the elastomeric connector 480 is tangent to the upper and lower plates 420 and 440 and the radius R is half of the overall distance from the upper plate 420 to the lower plate 440 in this illustrated embodiment. This shape prevents the elastomeric connector 480 from pinching or going into tension when the elastomeric material is compressed.

In this illustrated embodiment, the elastomeric connector 480 is formed from a rubber having a Shore A durometer in the range of 65-95, and preferably about 80. This elastomeric material provides for the higher shear rate. This higher shear stiffness pad assists in stabilizing the wheel set axles at high speed and thus reduces loaded car truck hunting. The shear stiffness for each of the longitudinal and lateral directions are about equal and within a preferred range of 85,000 to 125,000 lbs/in for a loaded railroad freight car. In this illustrated embodiment, the body 482 of the elastomeric connector 480 has a generally uniform thickness. The uncompressed thickness is nominally about 15/32 inches.

This illustrated configuration of the adapter shear pad 400: (1) provides the vertical stiffness required to ensure shearing; (2) minimizes edge stresses due to pitching (rocking) motions; (3) does not require a plate to increase the shape factor; and (4) has curved edges to minimize tension stresses when the rubber is loaded, for both vertical and horizontal action.

The grounding strap 500 provides electric continuity between the upper plate 420 and the lower plate 440. The grounding strap 500 includes a wire 510, a first connector 512 attached to one end of the wire 510, and a second connector 514 attached to the opposite end of the wire 510. A first fastener 516 removably attaches the first connector 512 to the flange 424 of the upper plate 420. A second fastener 518 removably attaches the second connector 514 to the flange 444 of the lower plate 440. It should be appreciated that other suitable mechanisms can be employed to provide electrical continuity between the upper plate 420 and the lower plate 440 in accordance with the present disclosure. For example, in alternative embodiments of the present disclosure, one or more conductive plugs are used to connect the upper and lower plates.

As indicated above, the first or leading side wear pad 600 and the second or trailing side wear pad 800 are identical in this illustrated example embodiment; however, it should be appreciated that in other embodiments, they are not identical. Thus, only the side wear pad 600 is discussed in further detail herein. It should thus be appreciated that such further explanation generally also applies to the side wear pad 800. The side wear pad 600 includes a transversely extending body 610, a first leg 640 longitudinally extending from a first end of the body 610, and a second leg 680 longitudinally extending from a second end of the body 610 (as best shown in FIGS. 3, 5, 6, 8, 9, and 10). The body 610 includes a roller bearing adapter engagement surface 612, a multi-level back surface 613 including a longitudinally extending lug engagement surface 614, a top surface 616, a bottom surface 618, a first end 620, and a second end 622. The body 610 includes a side wear pad locking mechanism in the form of walls or surfaces that define an inwardly extending engagement pocket 630 in the roller bearing adapter engagement surface 612 configured to receive the locking arm 280 and specifically the central section 282 of the locking arm 280 extending from the front surface 213 of the body 210 of the roller bearing adapter 200.

The first leg 640 includes a roller bearing adapter facing end 642, a free end 644, a slanted or angled top surface 646, a bottom surface 648, a leg engagement surface 650, and an inner surface 652. The first leg 640 includes a side wear pad locking mechanism in the form of walls or surfaces that define an inwardly extending engagement pocket 654 in the leg engagement surface 650 configured to receive the locking arm 280 and specifically the first side section 283 extending transversely from the inner surface of the leg 250.

The second leg 680 includes a roller bearing adapter facing end 682, a free end 684, a slanted or angled top surface 686, a bottom surface 688, a leg engagement surface 690, and an inner surface 692. The second leg 680 includes a side wear pad locking mechanism in the form of walls or surfaces that define an inwardly extending engagement pocket 694 in the leg engagement surface 690 configured to receive the locking arm 280 and specifically the second side section 284 extending transversely from the inner surface of the leg 220.

It should be appreciated that the side wear pad 600 is attached to the roller bearing adapter 200 by positioning the side wear pad 600 such that the locking arm 280 and specifically, the first, second, and third sections 282, 283, and 284 of the locking arm 280 are respectively positioned in the arm receiving pockets 630, 654, and 694 of the side wear pad 600 such that the surfaces that form the receiving pockets 630, 654, and 694 are in frictional engagement with the surfaces of locking arm 280. In certain embodiments, the dimensions are sized such that this is a press fit. It should be appreciated that side wear pad 800 is attached to the roller bearing adapter 200 in the same manner in this illustrated example embodiment. This illustrated example embodiment thus provides for respective engagement of the side wear pad locking mechanisms of the side wear pads 600 and 800 and the roller bearing adapter 200.

It should be appreciated that in alternative embodiments, the side wear pad can have the locking arm and the roller bearing adapter can define the receiving pockets as further described below. It should also be appreciated that in alternative embodiments, the side wear pad can be attached to the roller bearing adapter in alternative manners or using alternative mechanisms as further described below. It should further be appreciated that in alternative embodiments, the side wear pads 600 and 800 can be attached to the roller bearing adapter in different ways.

In this illustrated embodiment, the side wear pads 600 and 800 are both made from urethane, a glass filled urethane, a nylon, a filled nylon, or one or more ceramics. In other embodiments, the side wear pads 600 and 800 are made from other suitable materials such as a suitable polyethylene, a suitable polyurethane, or other suitable low-wear material. In other embodiments, the side wear pads 600 and 800 are made from a metal with suitable hardness for optimum wear. In other embodiments, the side wear pads 600 and 800 are made from different materials.

In use, the lower plate 440 of the adapter shear pad 400 is positioned or seated on the substantially planar top surface 211 of the roller bearing adapter 200, the leading side wear pad 600 is attached to the first, front or leading side 213 of the body 210 of the roller bearing adapter 200, and the trailing side wear pad 800 is attached to the second, rear or trailing side 214 of the body 210 of the roller bearing adapter 200, to collectively define the roller bearing adapter assembly of this illustrated example embodiment of the present disclosure. This bearing adapter assembly is placed within a pedestal jaw opening 33 of a high warp railroad car truck with: (1) the upper plate 420 of the adapter shear pad 400 engaging the side frame pedestal roof 28; (2) the bottom surface 350 of the roller bearing adapter 200 engaging an axle bearing (not shown); (3) the first side wear pad 600 facing the lug 32; and (4) the second side wear pad 800 facing the lug 30. Constant contact side bearings may also be employed in combination with this bearing adapter assembly in accordance with the present disclosure as further discussed herein.

As mentioned above, the combination of components of the roller bearing adapter assembly of the present disclosure reduces wheel set wear or damage by improving truck steering. This improved truck steering is provided by the combination of the shear pad and by roller bearing adapter and side wear pads having an increased longitudinal clearance between leading and trailing sides thereof and the respective side frame thrust lugs. More specifically, the shear pad decouples the frictional resistance between the side frame pedestal roof and the roller bearing adapter, enabling the wheel set to steer better. The additional clearance from the side wear pads enables the wheel set to better radially align with curves and particularly tighter curves. The side wear pads reduce the amount of wear on the ductile iron roller bearing adapter and the side frame thrust lugs, and thus reduce the likelihood that the clearance between the roller bearing adapter and the side frame thrust lugs will increase over time, or at least substantially reduce the rate of increase of such clearance.

As also mentioned above, the combination of components of the roller bearing adapter assembly of the present disclosure reduces wheel set wear and damage by reducing or inhibiting truck hunting (without unduly limiting steering). This reduction or inhibiting of truck hunting is provided by the increased stiffness of the shear pad such that when the truck encounters different track perturbations, the stiffer shear pad will minimize wheel set oscillation and thus eliminate or substantially reduce instability.

However, it should be appreciated that the stiffer shear pad will not be too stiff to unduly limit the needed movement of the axles and wheels relative to each other during turns or on curved tracks or rails. In other words, the stiffer shear pad will not unduly limit the ability of the outside wheels to travel a greater distance when traversing a curve than the distance traveled by the inside wheels when traversing that curve. It should also be appreciated that this better reduction or inhibiting of truck hunting is also simultaneously provided by the high warp stiffness truck that limits or restrains warping, parallelogramming, and lozenging.

In addition to reducing wheel set wear and damage, as also mentioned above, the combination of components of the roller bearing adapter assembly of the present disclosure better addresses the ever increasing and expected future demands for freight car truck performance in the railroad industry by reducing wheel rolling resistance, reducing railroad freight train fuel consumption, and by reducing the necessary railroad track or rail repair and reconstruction.

It should also be appreciated from the above described example embodiments that the present disclosure relates to: (1) a high warp restraint railroad car truck having a railroad car roller bearing adapter assembly including a roller bearing adapter, an adapter shear pad, and side wear pads; (2) a railroad car roller bearing adapter assembly including a roller bearing adapter, an adapter shear pad, and side wear pads configured to be used in a high warp restraint truck (with or without an auxiliary retrofit or original warp restraint system); (3) a railroad car roller bearing adapter assembly including a roller bearing adapter, an adapter shear pad, and side wear pads; (4) a railroad car truck including roller bearing adapter assembly including a roller bearing adapter, an adapter shear pad, and side wear pads; (5) a new roller bearing adapter; (6) a new adapter shear pad; and (7) a new side wear pad.

In further embodiments of the present disclosure, the roller bearing adapter, the adapter shear pad, and the side wear pads are also employed on a railcar with constant contact side bearings to further minimize truck hunting and specifically side to side or transverse movement to keep the truck more stable.

Referring now to FIGS. 11, 12, 13, 14, 15, 16, and 17, another example embodiment of the roller bearing adapter assembly of the present disclosure is illustrated and generally indicated by numeral 1100. The roller bearing adapter assembly 1100 is configured to be positioned on a roller bearing (not shown), which in turn, is positioned on a wheel set axle (not shown). Similar to the roller bearing adapter assembly 100, the roller bearing adapter assembly 1100 is configured to be positioned in the pedestal jaw opening 33 adjacent to the top wall or pedestal roof 28, and between the inside wall 26 and the outside wall 27. The roller bearing adapter assembly 1100 of this illustrated example embodiment of the present disclosure generally includes a roller bearing adapter 1200, an adapter shear pad 1400, and leading and trailing side wear pads 1600 and 1800. In this illustrated example embodiment, the side wear pads 1600 and 1800 are identical, although it should be appreciated that the side wear pads do not need to be identical in accordance with the present disclosure. The adapter shear pad 1400 is configured to be positioned on the roller bearing adapter 1200, and the leading and trailing side wear pads 1600 and 1800 are configured to be positioned on opposite sides of the roller bearing adapter 1200 as best shown in FIGS. 11, 12, 13, 14, and 15.

In this illustrated example embodiment, the roller bearing adapter 1200 has a relatively low profile thickness and is relatively narrow in the longitudinal direction. The roller bearing adapter 1200 generally includes a longitudinally and laterally extending body 1210, a plurality of legs 1220, 1230, 1240, and 1250 respectively integrally connected to and extending downwardly from the four corners of the body 1210, and a plurality of extensions 1260 and 1270 extending in opposite directions laterally or transversely outwardly from the opposite sides of the body 1210.

More specifically, the body 1210 includes a top surface 1211, a bottom surface 1212, a first, front or leading surface 1213, a second, back or trailing surface 1214, a first side surface 1215, and a second side surface 1216. The top surface 1211 of the body 1210 of the roller bearing adapter 1200 is substantially rectangular, generally flat in the longitudinal direction, and slightly arcuate in the lateral or transverse direction. The bottom surface 1212 of the body 1210 has a generally concave shape extending from the front surface 1213 to the back surface 1214. The bottom surface 1212 of the body 1210 and the inner walls of the legs 1220, 1230, 1240, and 1250 of the roller bearing adapter 1200 partially define a generally arcuate opening 1350 configured to receive the roller bearing (not shown). The bottom surface 1212 of the body 1210 is flat in the lateral or transverse direction while curved in the longitudinal direction.

The extensions 1260 and 1270 have a somewhat reduced height compared to the top surface 1211. Spaced apart tabs 1262 and 1264 protrude or extend from extension 1260. Spaced apart tabs 1272 and 1274 protrude or extend from extension 1270. The tabs 1262 and 1264 are spaced to receive there between the flange 1444 of the adapter shear pad 1400. The tabs 1272 and 1274 are spaced to receive there between the flange (not shown) of the adapter shear pad 1400.

The thickness of the body 1210 is reduced compared to a standard roller bearing adapter. The thickness is about 0.80 inches in this illustrated embodiment. This is approximately 9/32 inches less than various known roller bearing adapters. The reduced thickness of the roller bearing adapter 1200 and the adapter shear pad 1400 permits the use of an elastomeric adapter shear pad without increasing coupler height with standard side frames configured for snap-on wear liners.

Figure 11:
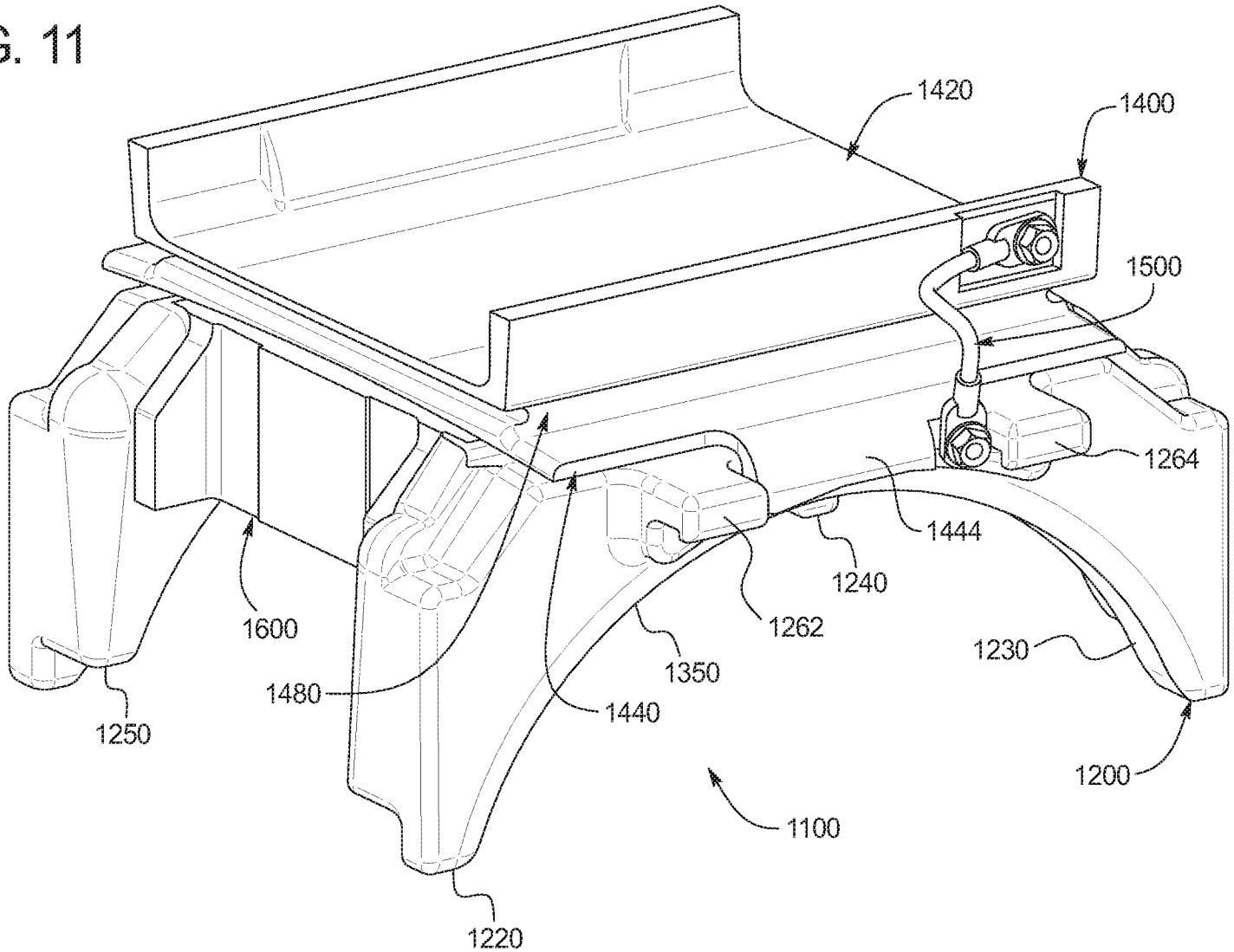
FIG. 11 is an enlarged top perspective view of an alternative example embodiment of the railroad car roller bearing adapter assembly of the present disclosure.
Figure 12:
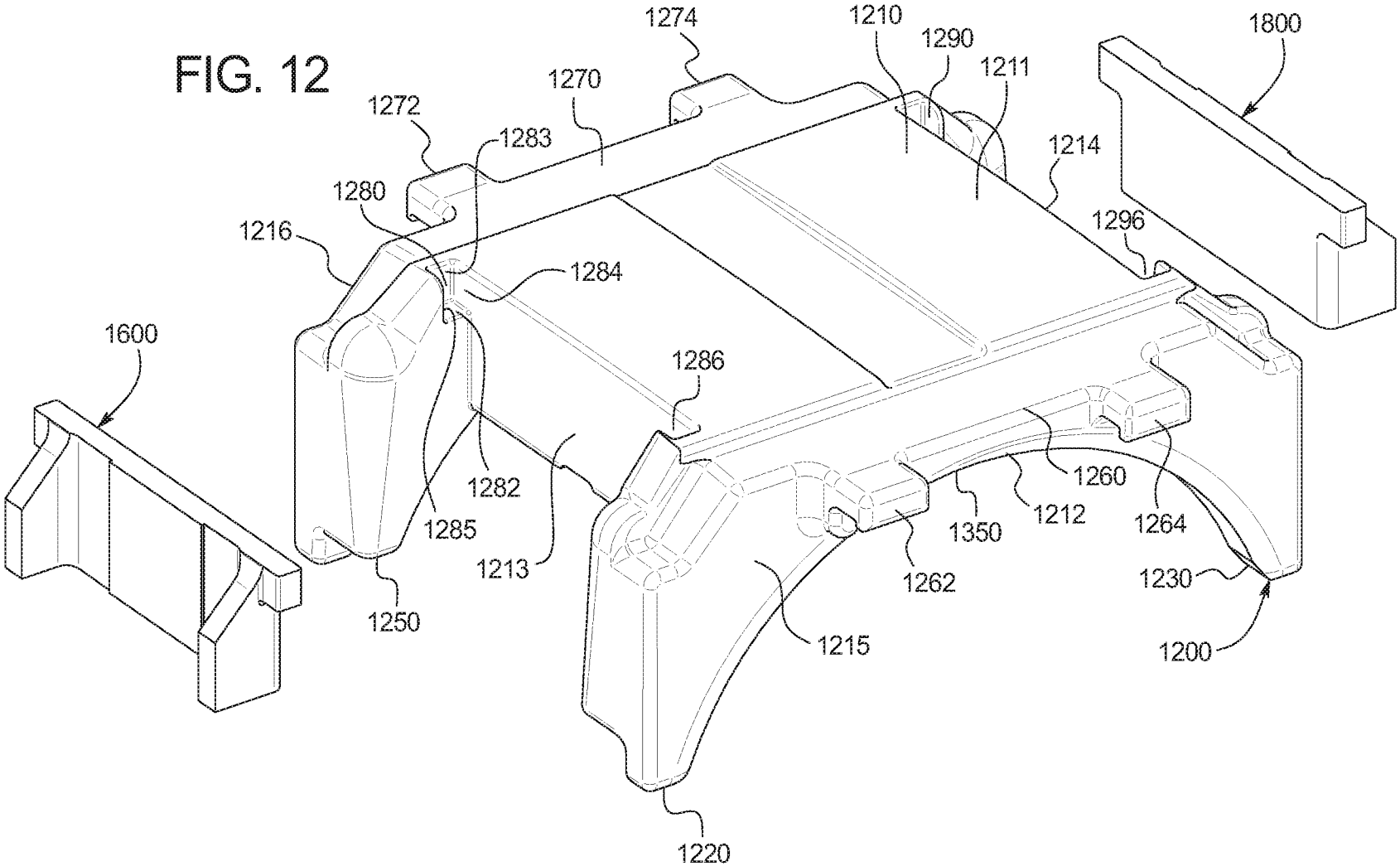
FIG. 12 is an enlarged exploded top perspective view of the roller bearing adapter and the leading and trailing side wear pads of the railroad car roller bearing adapter assembly of the railroad car roller bearing adapter assembly of FIG. 11.
Figure 13:
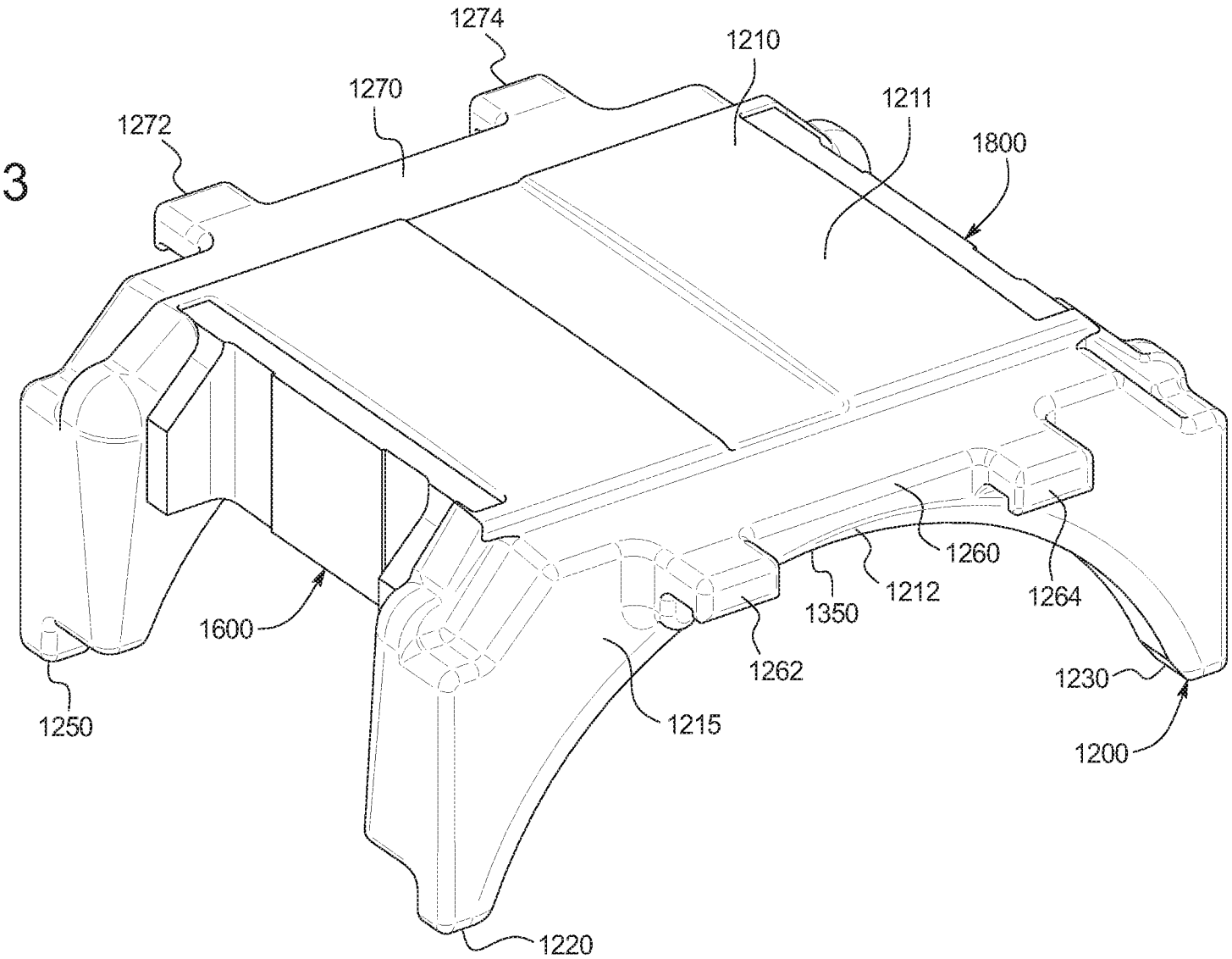
FIG. 13 is an enlarged top perspective view of the roller bearing adapter and side wear pads connected to the roller bearing adapter of the railroad car roller bearing adapter assembly of FIG. 11.
Figure 14:
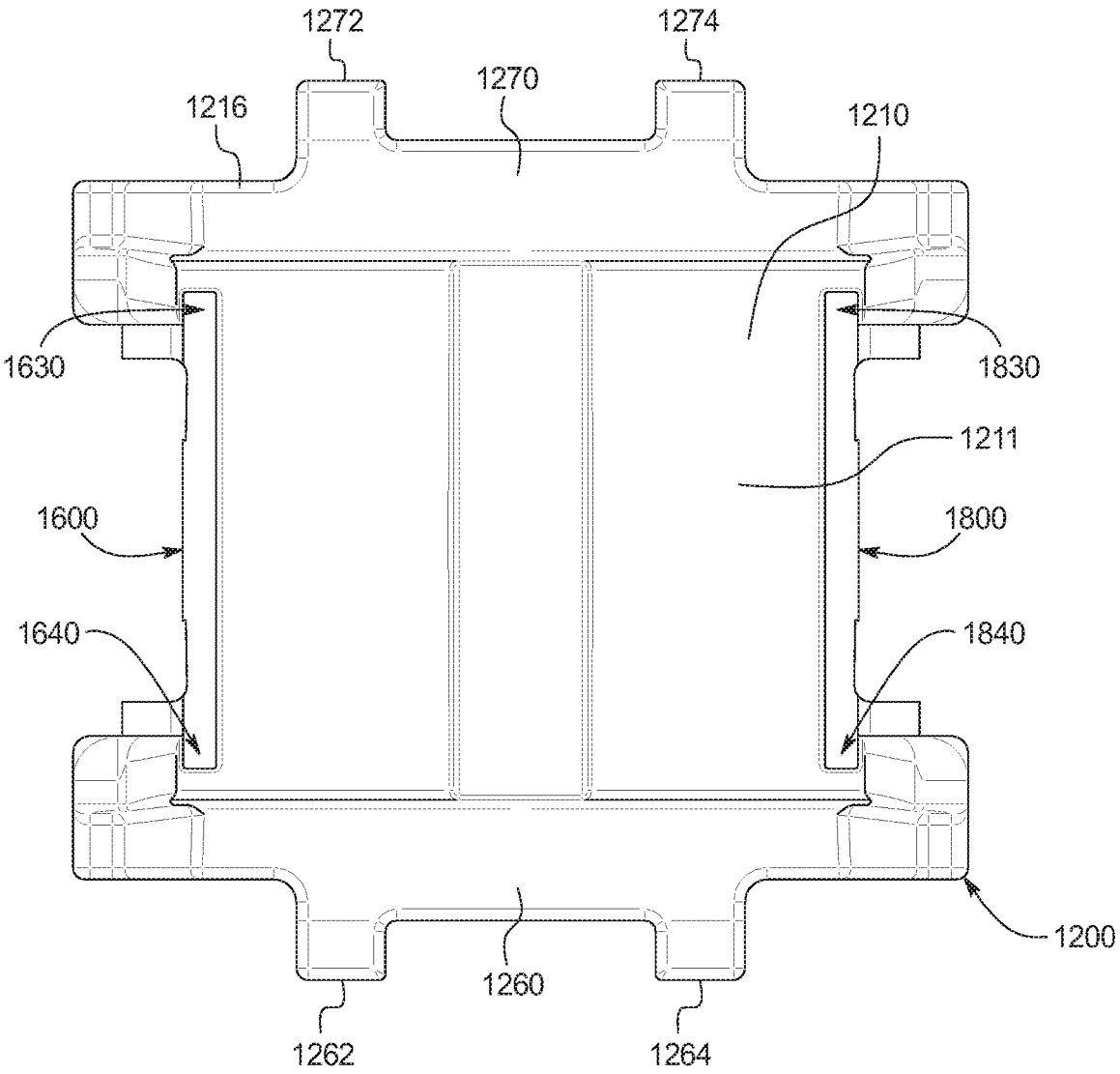
FIG. 14 is an enlarged top view of the roller bearing adapter and side wear pads connected to the roller bearing adapter of the railroad car roller bearing adapter assembly of FIG. 11.

The roller bearing adapter 1200 of this illustrated example embodiment includes alternative leading and trailing side wear pad locking mechanisms that are configured to operate or co-act with corresponding locking mechanisms on the leading and trailing side wear pads 1600 and 1800 to respectively removably connect or attach and secure or lock the side wear pads 1600 and 1800 to the roller bearing adapter 1200 (as best shown in FIGS. 11, 13, 14, and 15). More specifically, in this illustrated embodiment, these alternative side wear pad locking mechanisms of the roller bearing adapter 1200 include side wear pad locking pockets 1280, 1286 1290, and 1296 (as best shown in FIG. 12) that are configured to respectively receive locking arms of the side wear pads 1600 and 1800 to attach and lock the side wear pads 1600 and 1800 to the roller bearing adapter 1200 as further discussed below. The locking pocket 1280 includes a longitudinally and laterally extending bottom wall or ledge 1282, an upwardly extending side wall 1283, an upwardly extending first wall 1284, and an upwardly extending second wall 1285. The upwardly extending first wall 1284 faces the upwardly extending second wall 1285. Each of the other side wear pad locking pockets 1286, 1290, and 1296 has the same or substantially the same configuration. In this illustrated example embodiment, the locking pockets 1280, 1286, 1290, and 1296 each have a generally rectangular cross section (in each of three different dimensions or directions); however, it should be appreciated that they can be otherwise suitably shaped and sized in accordance with the present disclosure.

In this illustrated example embodiment, the roller bearing adapter 1200 is a unitary cast ductile iron structure, although it can be formed in other suitable manners and from other suitable materials in accordance with the present disclosure. It should also be appreciated that the roller bearing adapter of the present disclosure can be implemented with differently configured roller bearings.

Figure 15:
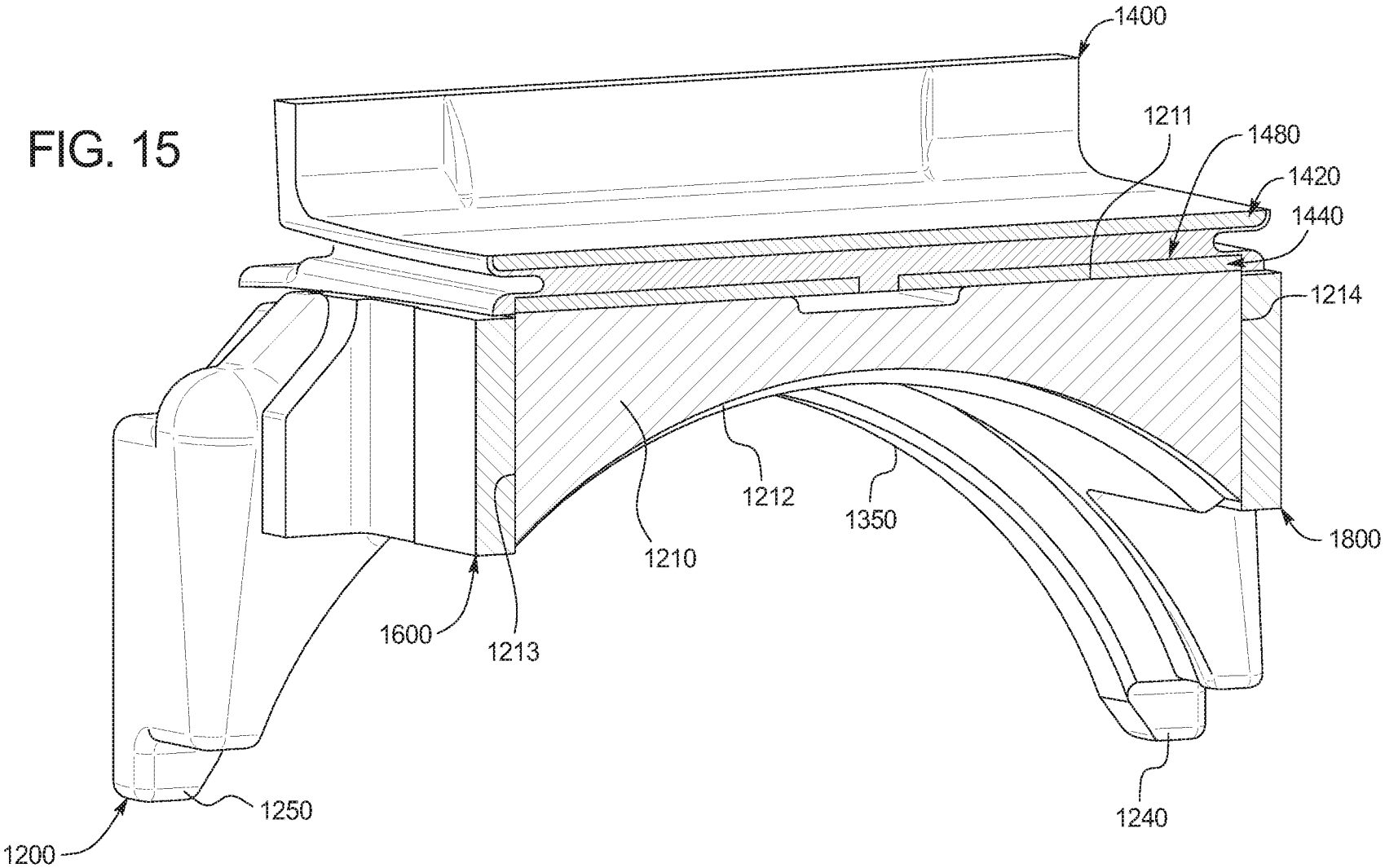
FIG. 15 is an enlarged perspective cross-sectional view of the assembled railroad car roller bearing adapter assembly of FIG. 11, and illustrating the roller bearing adapter, the adapter shear pad, and the two side wear pads of the railroad car roller bearing adapter assembly.

The adapter shear pad 1400 has a relatively low profile thickness and a relatively high shear stiffness in this illustrated example embodiment. The adapter shear pad 1400 generally includes an upper plate 1420, a lower plate 1440, an elastomeric connector 1480 connecting the upper plate 1420 and the lower plate 1440, and a grounding strap 1500 connected to the upper plate 420 and connected to the lower plate 1440 (as best shown in FIGS. 11 and 15). In this illustrated example embodiment, the adapter shear pad 1400 is identical to the adapter shear pad 400 discussed above.

Figure 16:
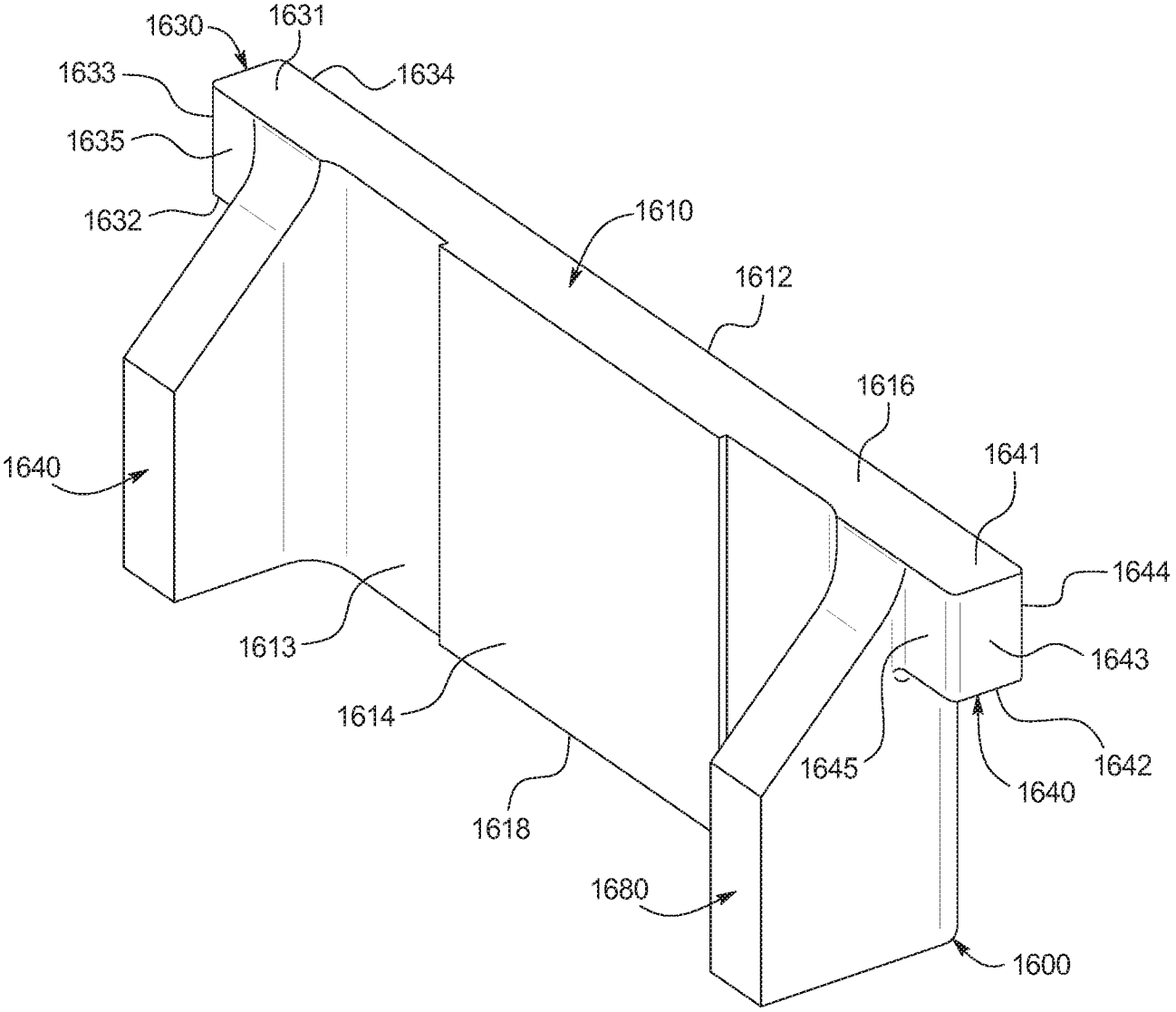
FIG. 16 is an enlarged rear perspective view of one of the side wear pads of the railroad car roller bearing adapter assembly of FIG. 11.
Figure 17:
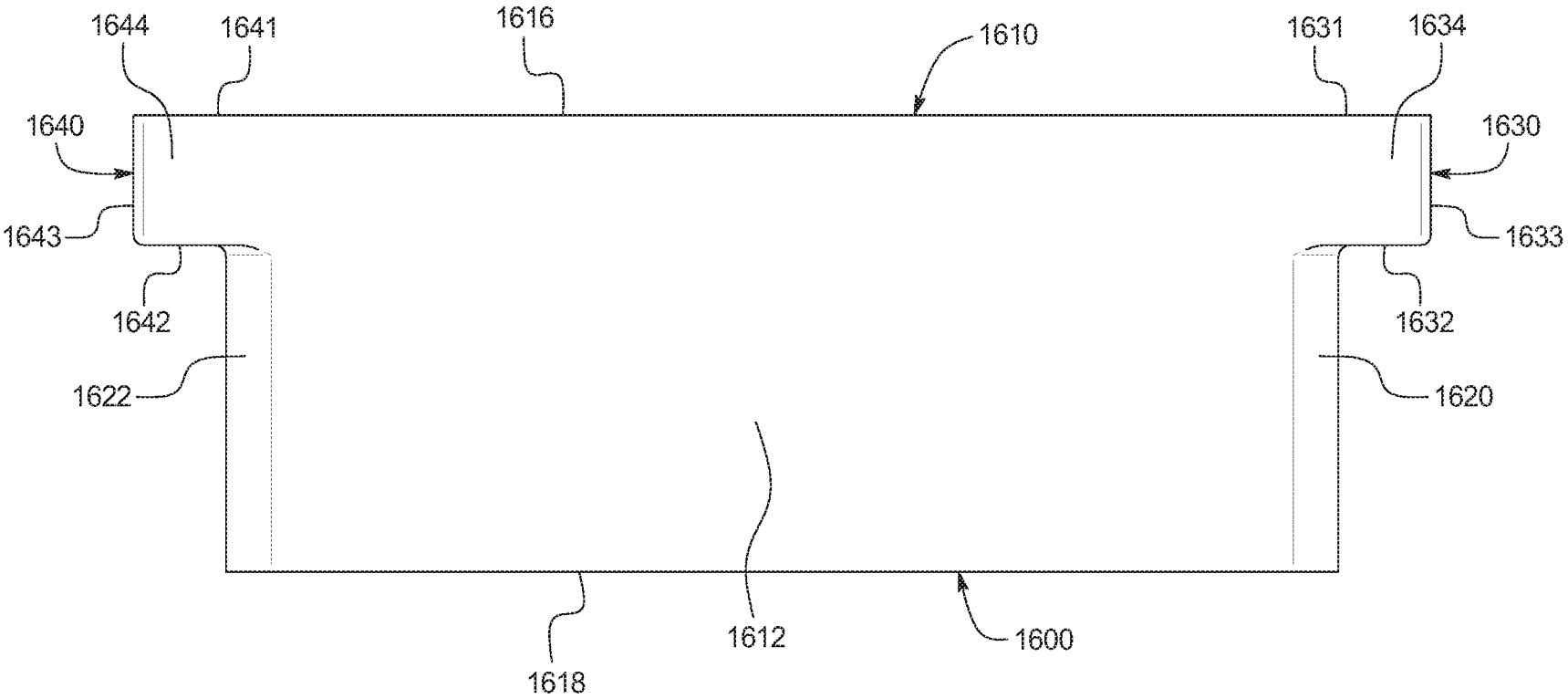
FIG. 17 is an enlarged front perspective view of one of the side wear pads of the railroad car roller bearing adapter assembly of FIG. 11.

As indicated above, the leading side wear pad 1600 and the trailing side wear pad 1800 are identical in this illustrated example embodiment. Thus, only the side wear pad 1600 is discussed in further detail herein. It should be appreciated that such further explanation generally applies to the side wear pad 1800. The side wear pad 1600 includes a transversely extending body 1610, a first leg 1640 longitudinally extending from a first end of the body 1610, and a second leg 1680 longitudinally extending from a second end of the body 1610 (as best shown in FIGS. 16 and 17). The body 1610 includes a roller bearing adapter engagement surface 1612, a multi-level back surface 1613 including a longitudinally extending lug engagement surface 1614, a top surface 1616, a bottom surface 1618, a first end 1620, and a second end 1622.

The leading side wear pad 1600 includes a side wear pad locking mechanism extending from the body 1610 in the form of locking arms 1630 and 1640 that are respectively configured to be received in locking pockets 1280 and 1286 (as shown in FIGS. 11, 12, 13, 14, and 15). Locking arm 1630 includes a top surface 1631, a bottom surface 1632, an end surface 1633, a first wall 1634, and a second wall 1635. Locking arm 1640 includes a top surface 1641, a bottom surface 1642, an end surface 1643, a first wall 1644, and a second wall 1645. When the locking arms 1630 and 1640 are positioned in the locking pockets 1280 and 1286, the locking arms 1630 and 1640 lock or secure the side wear pad 1600 to the roller bearing adapter 1200. Likewise, when the locking arms 1830 and 1840 are positioned in the locking pockets 1290 and 1296, the locking arms 1830 and 1840 lock or secure the side wear pad 1800 to the roller bearing adapter 1200. In this illustrated example embodiment, the locking arms 1630, 1640, 1830, and 1840 each have a generally rectangular cross section (in each of three different dimensions or directions); however, it should be appreciated that they can be otherwise suitably shaped and sized in accordance with the present disclosure. In this illustrated example embodiment, when the adapter shear pad 1400 is seated on the substantially planar top surface 1211 of the roller bearing adapter 1200, the adapter shear pad 1400 prevents both the side wear pad 1600 and the side wear pad 1800 from moving upwardly. Thus, the adapter shear pad 1400 holds both the side wear pad 1600 and the side wear pad 1800 in place as generally shown in FIGS. 11 and 15.

This roller bearing adapter assembly is placed within a pedestal jaw opening 33 of a high warp railroad car truck with: (1) the upper plate 1420 of the adapter shear pad 1400 engaging the side frame pedestal roof 28; (2) the bottom surface 1350 of the roller bearing adapter 1200 engaging an axle bearing (not shown); (3) the first or leading side wear pad 1600 engaging the lug 32; and (4) the second or trailing side wear pad 1800 engaging the lug 30. This roller bearing adapter assembly 1100 of the present disclosure provides the same advantages discussed above with respect to assembly 100. Additionally, this assembly 1100 includes a more secure engagement or connection between the adapter 1200 and the side wear pads 1600 and 1800.

Figure 18:
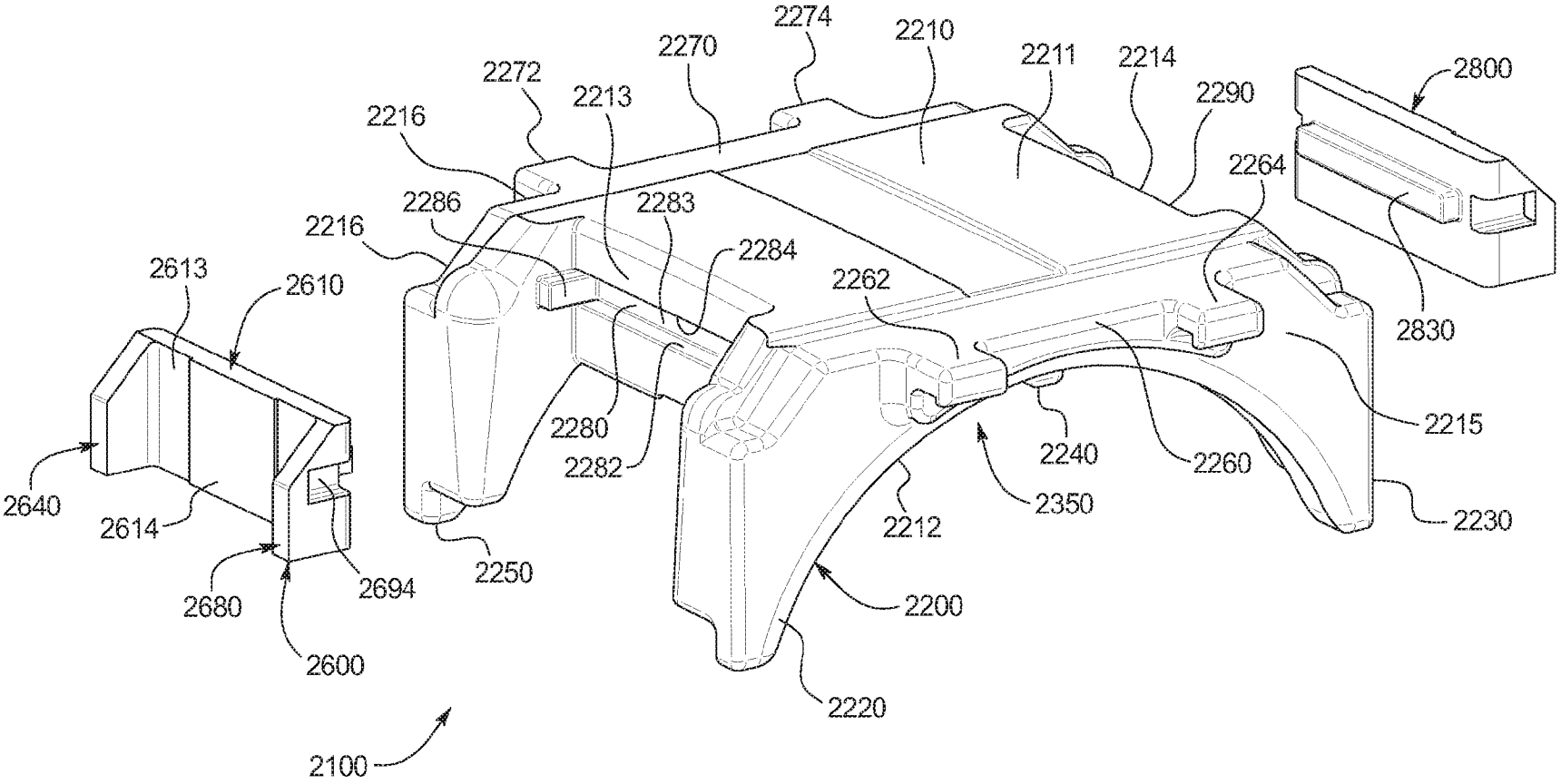
FIG. 18 is an enlarged exploded top perspective view of a further alternative example embodiment of the railroad car roller bearing adapter assembly of the present disclosure, and illustrating the roller bearing adapter, the adapter shear pad, and the two side wear pads of this alternative embodiment of the railroad car roller bearing adapter assembly.
Figure 19:
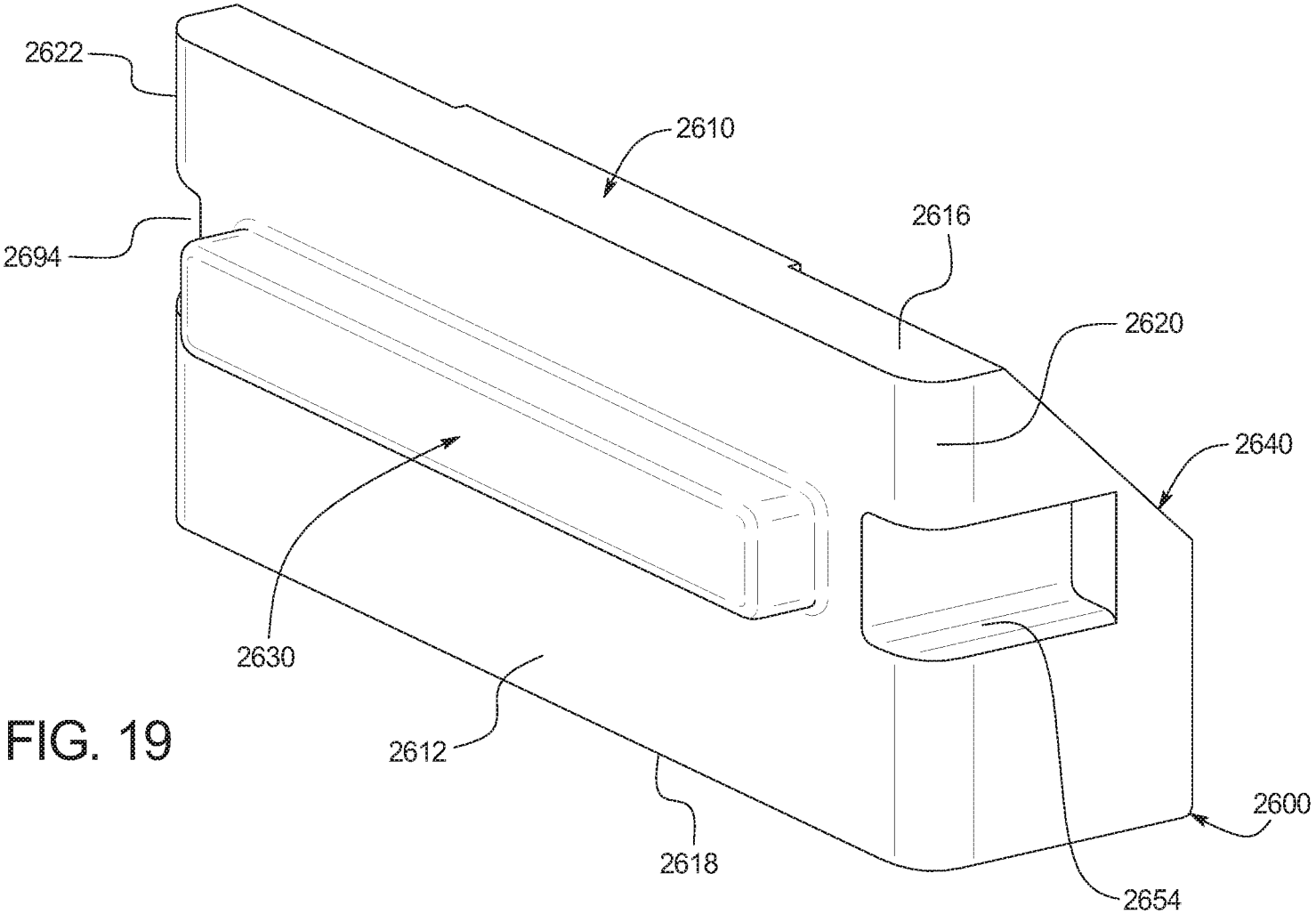
FIG. 19 is an enlarged front perspective view of one of the side wear pads of the railroad car roller bearing adapter assembly of FIG. 18.

Referring now to FIGS. 18 and 19, another example embodiment of the roller bearing adapter assembly of the present disclosure is illustrated and generally indicated by numeral 2100. The roller bearing adapter assembly 2100 is configured to be positioned on a roller bearing (not shown), which in turn, is positioned on an axle (not shown). Similar to the roller bearing adapter assembly 100, the roller bearing adapter assembly 2100 is configured to be positioned in the pedestal jaw opening 33 adjacent to the top wall or pedestal roof 28, and between the inside wall 26 and the outside wall 27 as further described below. The roller bearing adapter assembly 2100 of this illustrated example embodiment of the present disclosure generally includes a roller bearing adapter 2200, an adapter shear pad (not shown in FIG. 18) similar to or identical to the adapter shear pads described above, and leading and trailing side wear pads 2600 and 2800. In this illustrated example embodiment, the side wear pads 2600 and 2800 are identical, although it should be appreciated that the side wear pads do not need to be identical in accordance with the present disclosure. The adapter shear pad (not shown in FIG. 18) is configured to be positioned on the roller bearing adapter 2200, and the side wear pads 2600 and 2800 are configured to be positioned on opposite sides of the roller bearing adapter 2200.

In this illustrated example embodiment, the roller bearing adapter 2200 has a relatively low profile thickness and is relatively narrow in the longitudinal direction. The roller bearing adapter 2200 generally includes a longitudinally and laterally extending body 2210, a plurality of legs 2220, 2230, 2240, and 2250 respectively integrally connected to and extending downwardly from the four corners of the body 2210, and a plurality of extensions 2260 and 2270 extending in opposite directions laterally or transversely outwardly from the opposite sides of the body 2210.

More specifically, the body 2210 includes a top surface 2211, a bottom surface 2212, a first, front or leading surface 2213, a second, back or trailing surface 2214, a first side surface 2215, and a second side surface 2216. The top surface 2211 of the body 2210 of the roller bearing adapter 2200 is substantially rectangular, generally flat in the longitudinal direction, and slightly arcuate in the lateral or transverse direction. The bottom surface 2212 of the body 2210 has a generally concave shape extending from the front surface 2213 to the back surface 2214. The bottom surface 2212 of the body 2210 and the inner walls of the legs 2220, 2230, 2240, and 2250 of the roller bearing adapter 2200 partially define a generally arcuate opening 2350 configured to receive the roller bearing (not shown). The bottom surface 2212 of the body 2210 is flat in the lateral or transverse direction.

The extensions 2260 and 2270 have a somewhat reduced height compared to the top surface 2211. Spaced apart tabs 2262 and 2264 protrude or extend from extension 2260. Spaced apart tabs 2272 and 2274 protrude or extend from extension 2270. The tabs 2262 and 2264 are spaced to receive there between the flange (not shown in FIG. 18) of the adapter shear pad (not shown in FIG. 18). The tabs 2272 and 2274 are spaced to receive there between the other flange (not shown in FIG. 18) of the adapter shear pad (not shown in FIG. 18).

The thickness of the body 2210 is reduced compared to a standard roller bearing adapter. The thickness is about 0.80 inches in this illustrated embodiment. This is approximately 9/32 inches less than various known roller bearing adapters. The reduced thickness of the roller bearing adapter 2200 and the adapter shear pad permits the use of an elastomeric adapter shear pad without increasing coupler height with standard side frames.

The roller bearing adapter 2200 of this illustrated example embodiment includes alternative leading and trailing side wear pad locking mechanisms that are configured to operate or co-act with corresponding locking mechanisms on the leading and trailing side wear pads 2600 and 2800 to respectively removably connect or attach and secure or lock the side wear pads 2600 and 2800 to the roller bearing adapter 2200. More specifically, in this illustrated embodiment, these alternative side wear pad locking mechanisms of the roller bearing adapter 2200 include side wear pad locking pockets that are configured to respectively receive locking arms of the side wear pads 2600 and 2800 to partially attach and lock the side wear pads 2600 and 2800 to the roller bearing adapter 2200. The locking pocket 2280 includes a longitudinally and laterally extending bottom wall or ledge 2282, an upwardly extending wall 2283, and a longitudinally and laterally extending top wall 2284. The bottom wall 2282 and the top wall 2284 face each other. In this illustrated embodiment, these alternative side wear pad locking mechanisms of the roller bearing adapter 2200 include side wear pad locking arms 2286 (and 2287, 2296, and 2297 that are not shown) that are configured to be respectively received in locking pockets in the side wear pads 2600 and 2800 to partially attach and lock the side wear pads 2600 and 2800 to the roller bearing adapter 2200. Each of the side wear pad locking pockets 2280 and 2290 has the same configuration in this illustrated example embodiment. Each of the side wear pad locking arms 2286 (and 2287, 2296, and 2297 that are not shown) has the same configuration in this illustrated example embodiment.

In this illustrated example embodiment, the locking pockets 2280, 2290, and the locking arms 2286 (and 2287, 2296, and 2297 that are not shown) each have a generally rectangular cross section (in each of three different dimensions or directions); however, it should be appreciated that they can be otherwise suitably shaped and sized in accordance with the present disclosure.

In this illustrated example embodiment, the roller bearing adapter 2200 is a unitary cast ductile iron structure, although it can be formed in other suitable manners or other suitable materials in accordance with the present disclosure. It should also be appreciated that the roller bearing adapter of the present disclosure can be implemented with differently configured roller bearings.

The adapter shear pad (not shown) has a relatively low profile thickness and has relatively high shear stiffness in this illustrated example embodiment. The adapter shear pad generally includes an upper plate, a lower plate, an elastomeric connector connecting the upper plate and the lower plate, and a grounding strap connected to the upper plate and connected to the lower plate. In this illustrated embodiment, the adapter shear pad is identical to the adapter shear pads 400 and 1400 discussed above.

As indicated above, the side wear pad 2600 and the side wear pad 2800 are identical in this illustrated example embodiment. Thus, only the side wear pad 2600 is discussed in further detail herein. It should be appreciated that such further explanation generally applies to the side wear pad 2800. The side wear pad 2600 includes a transversely extending body 2610, a first leg 2640 longitudinally extending from a first end of the body 2610, and a second leg 2680 longitudinally extending from a second end of the body 2610. The body 2610 includes a roller bearing adapter engagement surface 2612, a multi-level back surface 2613 including a longitudinally extending lug engagement surface 2614, a top surface 2616, a bottom surface 2618, a first end 2620, and a second end 2622.

The side wear pad 2600 includes a side wear pad locking mechanism extending from the body 2610 in the form of a locking arm 2630 that is configured to be received in locking pocket 2280. The side wear pad 2600 further includes side wear pad locking mechanisms in the form of locking pockets 2654 and 2694 defined in the body 2610 and the legs 2640 and 2680. In this illustrated example embodiment, the locking arms 2630 and 2830 each have a generally rectangular cross section (in each of three different dimensions or directions); however, it should be appreciated that they can be otherwise suitably shaped and sized in accordance with the present disclosure. In this illustrated example embodiment, the locking pockets 2654 and 2694 each have a generally rectangular cross section (in each of three different dimensions or directions); however, it should be appreciated that they can be otherwise suitably shaped and sized in accordance with the present disclosure.

This bearing adapter assembly is placed within a pedestal jaw opening 33 of a high warp railroad car truck with: (1) the upper plate of the adapter shear pad engaging the side frame pedestal roof 28; (2) the bottom surface 2212 of the roller bearing adapter 2200 engaging an axle bearing (not shown); (3) the first side wear pad 2600 engaging the lug 32; and (4) the second side wear pad 2800 engaging the lug 30. This roller bearing adapter assembly 2100 of the present disclosure provides the same advantages discussed above with respect to assembly 100.

The present disclosure also provides that the shear pad of the present disclosure can include different configurations to provide the desired amount of stiffness to the shear pad.

Figure 20:
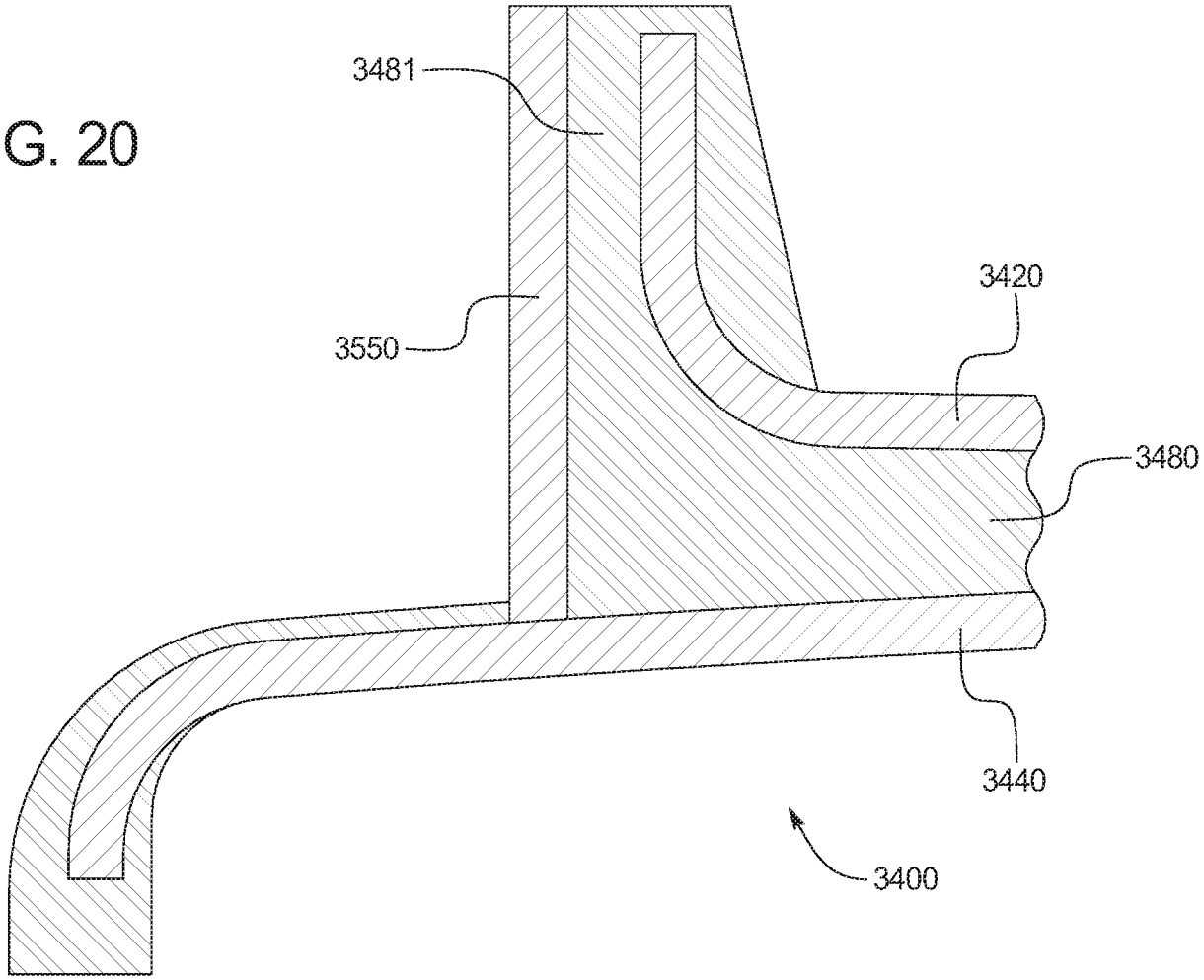
FIG. 20 is an enlarged partial fragmentary cross-sectional view of an alternative example embodiment of the shear pad of the present disclosure.

Turning now to FIG. 20, one alternative embodiment of the shear pad of the present disclosure that includes additional elastomeric material and that is generally illustrated and indicated by numeral 3400. This alternative shear pad 3400 generally includes an upper plate 3420, a lower plate 3440, an elastomeric connector 3480 connecting the upper plate 3420 and the lower plate 3440, and a grounding strap (not shown) connected to the upper plate 3420 and connected to the lower plate 3440. This alternative shear pad 3400 further includes additional elastomeric connector 3481 running vertically or substantially vertically and connecting vertical plate 3550 with upper plate 3420. The additional elastomeric material 3481 increases the longitudinal shear stiffness. The lateral stiffness also increases due to the compression of the elastomeric material 3481. Elastomeric connector 3480 thus has a high compression to shear stiffness. Additional or alternative connecting plates may be manufactured as a one piece formed plate and/or welded into position prior to molding.

Figure 21:
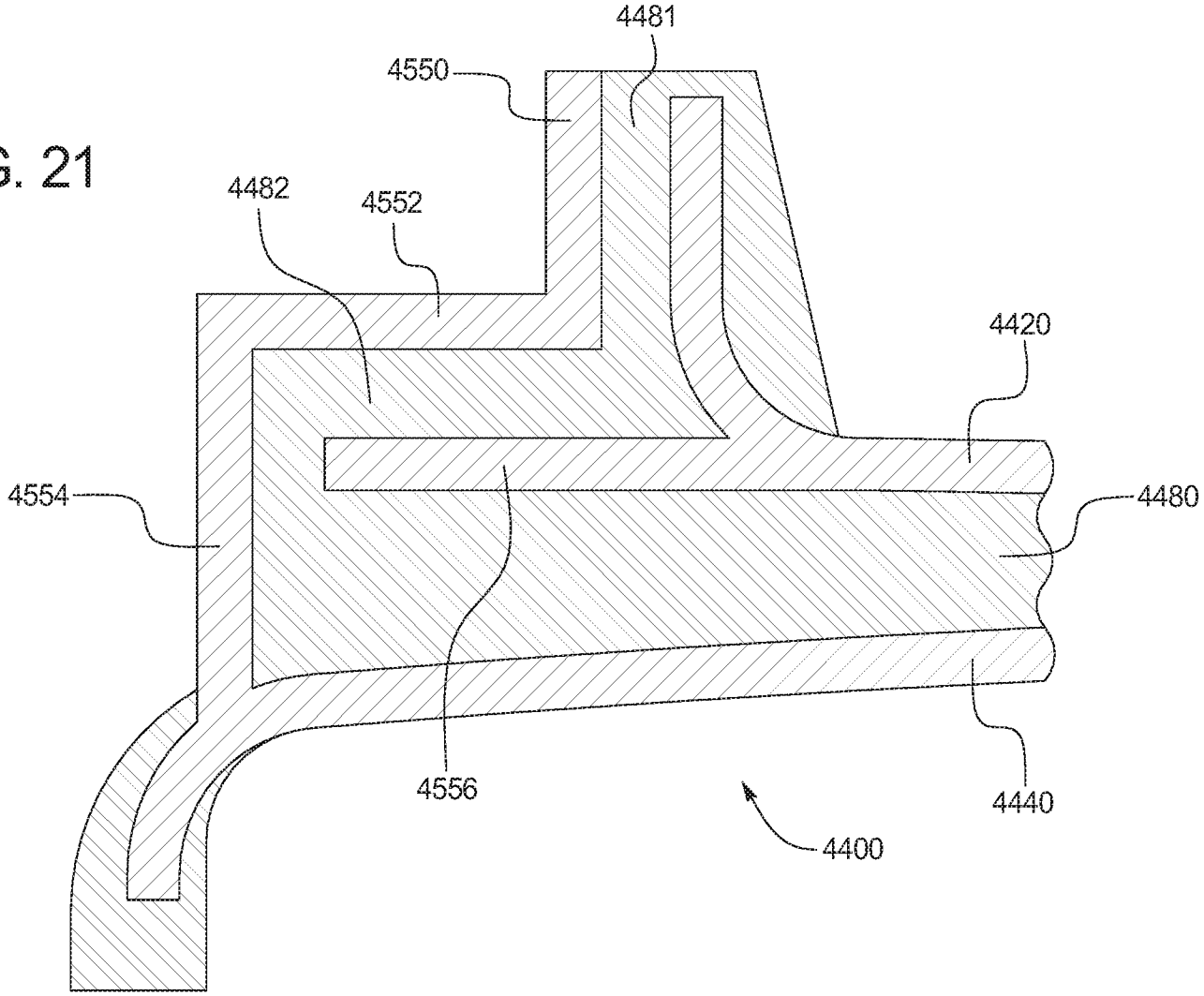
FIG. 21 is an enlarged partial fragmentary cross-sectional view of a further alternative example embodiment of the shear pad of the present disclosure.

Turning now to FIG. 21, another alternative embodiment of the shear pad of the present disclosure that includes additional elastomeric material and that is generally illustrated and indicated by numeral 4400. This alternative shear pad 4400 generally includes an upper plate 4420, a lower plate 4440, an elastomeric connector 4480 connecting the upper plate 4420 and the lower plate 4440, and a grounding strap (not shown) connected to the upper plate 4420 and connected to the lower plate 4440. This alternative shear pad 4400 further includes a plurality of auxiliary steel plates such as auxiliary plates 4550, 4552, 4554, and 4556. Additional elastomeric connector 4481 and 4482 increase the longitudinal shear stiffness and lateral stiffness due to additional material and the compression of elastomeric material 4481.

Figure 22:
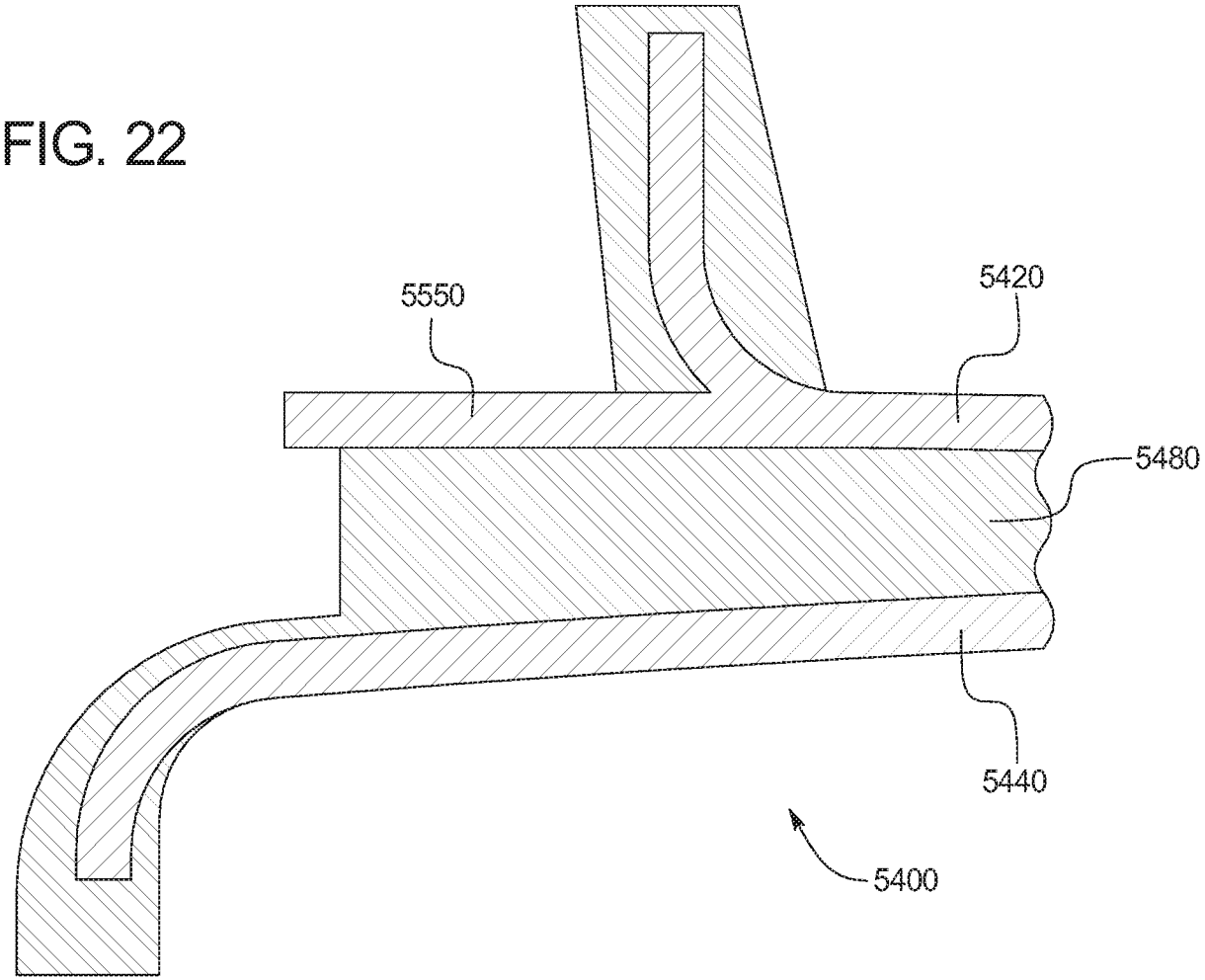
FIG. 22 is an enlarged partial fragmentary cross-sectional view of a further alternative example embodiment of the shear pad of the present disclosure.

Turning now to FIG. 22, another alternative embodiment of the shear pad of the present disclosure that includes one or more additional or auxiliary shear pad stiffeners is generally illustrated and indicated by numeral 5400. This alternative shear pad 5400 generally includes an upper plate 5420, a lower plate 5440, an elastomeric connector 5480 connecting the upper plate 5420 and the lower plate 5440, and a grounding strap (not shown) connected to the upper plate 5420 and connected to the lower plate 5440. This alternative shear pad 5400 further includes at least one auxiliary steel plate 5550 that increases the shape factor and longitudinal and lateral shear stiffness.

Figure 23:
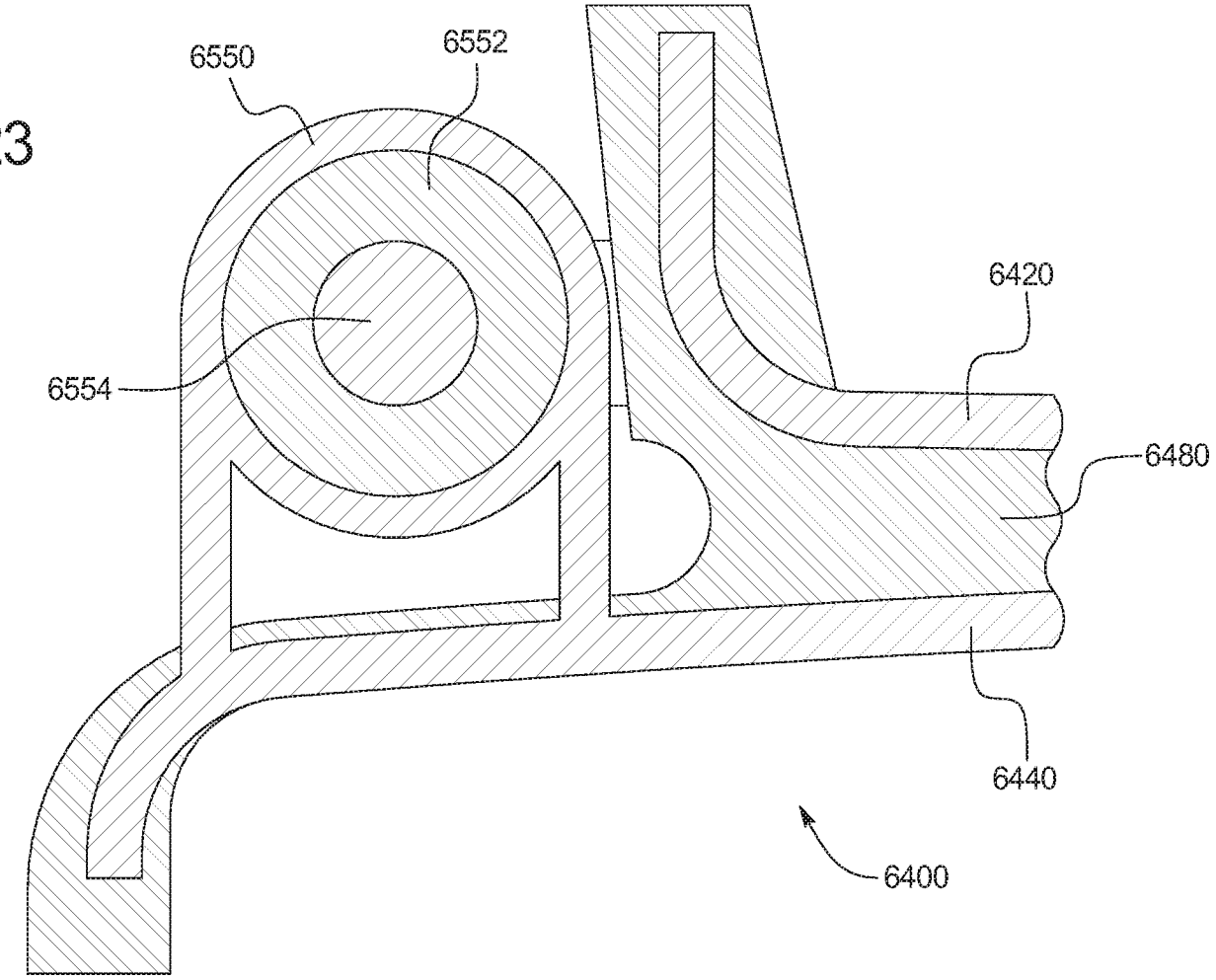
FIG. 23 is an enlarged partial fragmentary cross-sectional view of a further alternative example embodiment of the shear pad of the present disclosure.
Figure 24:
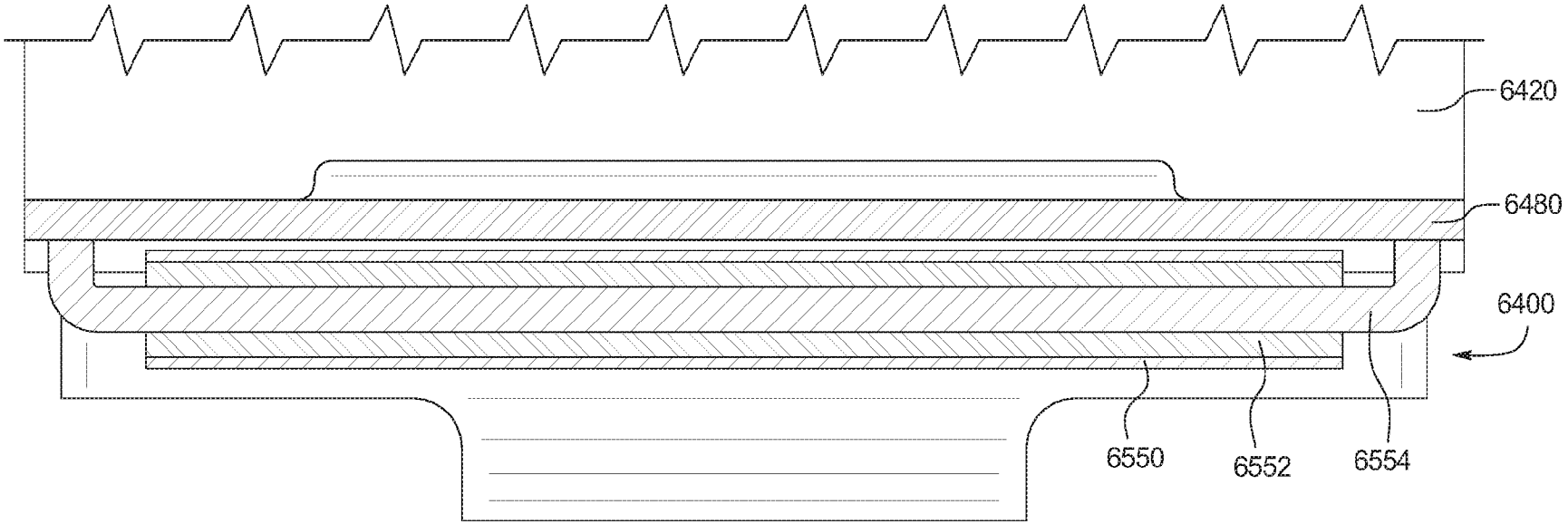
FIG. 24 is an enlarged partial fragmentary cross-sectional view of the further alternative example embodiment of the shear pad of the present disclosure of FIG. 23.

Turning now to FIGS. 23 and 24, another alternative embodiment of the shear pad of the present disclosure that includes one or more additional or auxiliary shear pad stiffeners is generally illustrated and indicated by numeral 6400. This alternative shear pad 6400 generally includes an upper plate 6420, a lower plate 6440, an elastomeric connector 6480 connecting the upper plate 6420 and the lower plate 6440, and a grounding strap (not shown) connected to the upper plate 6420 and connected to the lower plate 6440. This alternative shear pad 6400 further includes a plurality of auxiliary steel shear pad stiffeners such as auxiliary steel shear pad stiffeners 6550, 6552, and 6554.

Figure 25:
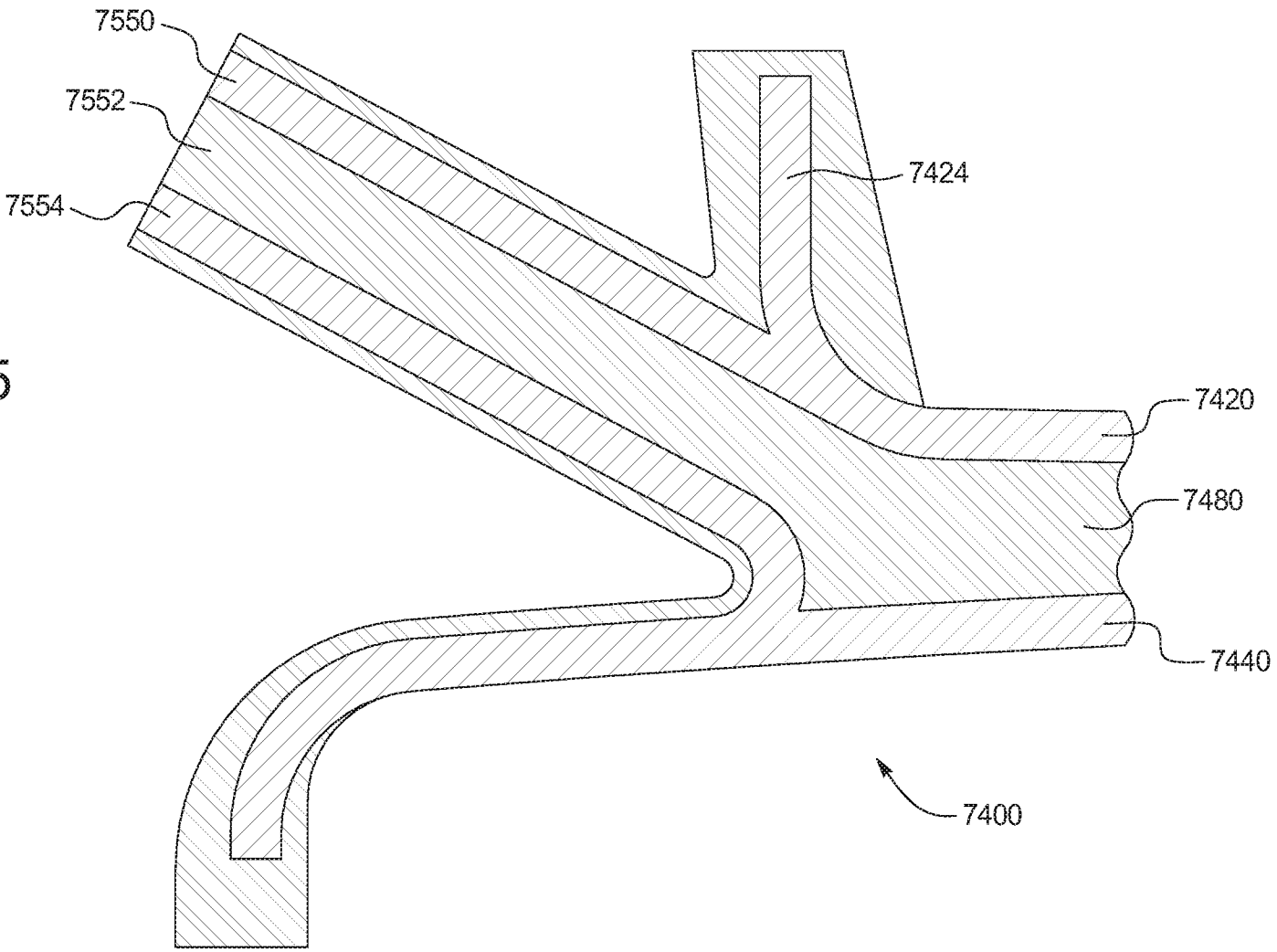
FIG. 25 is an enlarged partial fragmentary cross-sectional view of a further alternative example embodiment of the shear pad of the present disclosure.

Turning now to FIG. 25, another alternative embodiment of the shear pad of the present disclosure that includes one or more additional or auxiliary shear pad stiffeners is generally illustrated and indicated by numeral 7400. This alternative shear pad 7400 generally includes an upper plate 7420, a lower plate 7440, an elastomeric connector 7480 connecting the upper plate 7420 and the lower plate 7440, and a grounding strap (not shown) connected to the upper plate 7420 and connected to the lower plate 7440. This alternative shear pad 7400 further includes a plurality of auxiliary steel shear pad stiffeners such as auxiliary steel shear pad stiffeners 7550 and 7554. Additional elastomeric connector 7552 may increase the longitudinal shear stiffness and lateral stiffness due to additional material shear and compression.

It will be understood that modifications and variations may be effected without departing from the scope of the novel concepts of the present invention, and it is understood that this application is to be limited only by the scope of the claims.

The invention is claimed as follows:

1. A railroad car comprising:

a high warp restraint truck; and a roller bearing adapter assembly including: (a) a roller bearing adapter, (b) an adapter shear pad having a longitudinal shear stiffness in a range of approximately 85,000 lbs/in and approximately 125,000 lbs/in, (c) a leading side wear pad, and (d) a trailing side wear pad, the roller bearing adapter, the leading side wear pad, and the trailing side wear pad providing a side frame thrust lug to adapter total clearance in a range of 0.09 inches to 0.36 inches in a jaw of a side frame of the high warp restraint truck.

2. The railroad car of claim 1, wherein the high warp restraint truck includes an auxiliary warp restraint system.

3. The railroad car of claim 1, wherein the high warp restraint truck does not include an auxiliary warp restraint system.

4. The railroad car of claim 1, wherein the high warp restraint truck includes constant contact side bearings.

5. The railroad car of claim 1, wherein the high warp restraint truck does not include constant contact side bearings.

6. The railroad car of claim 1, wherein the adapter shear pad includes an auxiliary stiffener.

7. The railroad car of claim 6, wherein the auxiliary stiffener includes an auxiliary layer of elastic material.

8. The railroad car of claim 6, wherein the auxiliary stiffener includes an auxiliary layer of elastic material and an auxiliary plate.

9. The railroad car of claim 6, wherein the auxiliary stiffener includes an auxiliary plate.

10. The railroad car of claim 1, wherein the adapter shear pad includes an upper plate, a lower plate, an elastomeric connector connecting the upper plate and the lower plate, and wherein the adapter shear pad has a relatively low profile thickness.

11. The railroad car of claim 1, wherein the side wear pads are made from one of: a urethane, a glass filled urethane, a nylon, a filled nylon, one or more ceramics, a polyethylene, and a polyurethane.

12. The railroad car of claim 1, wherein roller bearing adapter includes opposing pockets defined in a leading portion of the roller bearing adapter.

13. The railroad car of claim 12, wherein the leading side wear pad includes opposing locking arms configured to be respectively received by the opposing pockets defined in the leading portion of the roller bearing adapter.

14. The railroad car of claim 1, wherein the roller bearing adapter includes opposing pockets defined in a trailing portion of the roller bearing adapter.

15. The railroad car of claim 14, wherein the trailing side wear pad includes opposing locking arms configured to be respectively received by the opposing pockets defined in the trailing portion of the roller bearing adapter.

16. A high warp restraint railroad truck bearing adapter assembly comprising:

a roller bearing adapter;

an adapter shear pad having a shear stiffness in a range of 85,000 lbs/in and 125,000 lbs/in;

a leading side wear pad; and a trailing side wear pad, wherein the roller bearing adapter, the leading side wear pad, and the trailing side wear pad have a side frame thrust lug to adapter total clearance in a range of 0.09 inches to 0.36 inches.

17. The high warp restraint railroad truck bearing adapter assembly of claim 16, wherein the adapter shear pad has a relatively low profile thickness.

18. The high warp restraint railroad truck bearing adapter assembly of claim 16, wherein the adapter shear pad includes an upper plate, a lower plate, and an elastomeric connector connecting the upper plate and the lower plate.

19. The high warp restraint railroad truck bearing adapter assembly of claim 16, wherein the adapter shear pad includes a grounding strap connectable to the upper plate and connectable to the lower plate.

20. The high warp restraint railroad truck bearing adapter assembly of claim 16, wherein the side wear pads are made from one of: a urethane, a glass filled urethane, a nylon, a filled nylon, one or more ceramics, a polyethylene, and a polyurethane.

21. The high warp restraint railroad truck bearing adapter assembly of claim 16, wherein roller bearing adapter includes opposing pockets defined in a leading portion of the roller bearing adapter.

22. The high warp restraint railroad truck bearing adapter assembly of claim 21, wherein the leading side wear pad includes opposing locking arms configured to be respectively received by the opposing pockets defined in the leading portion of the roller bearing adapter.

23. The high warp restraint railroad truck bearing adapter assembly of claim 16, wherein the roller bearing adapter includes opposing pockets defined in a trailing portion of the roller bearing adapter.

24. The high warp restraint railroad truck bearing adapter assembly of claim 23, wherein the trailing side wear pad includes opposing locking arms configured to be respectively received by the opposing pockets defined in the trailing portion of the roller bearing adapter.

* * * * *